US010665148B2

(12) United States Patent
Kang et al.

(10) Patent No.: US 10,665,148 B2
(45) Date of Patent: May 26, 2020

(54) DISPLAY APPARATUS AND METHOD OF DRIVING DISPLAY PANEL USING THE SAME

(71) Applicant: SAMSUNG DISPLAY CO., LTD., Yongin-si, Gyeonggi-do (KR)

(72) Inventors: Sun-Koo Kang, Seoul (KR); Jae-Han Lee, Hwaseong-si (KR); Ok-Kwon Shin, Seoul (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 140 days.

(21) Appl. No.: 15/868,581

(22) Filed: Jan. 11, 2018

(65) Prior Publication Data

US 2018/0308414 A1 Oct. 25, 2018

(30) Foreign Application Priority Data

Apr. 24, 2017 (KR) ..... 10-2017-0052465

(51) Int. Cl.
*G09G 3/20* (2006.01)
*G09G 3/36* (2006.01)

(52) U.S. Cl.
CPC ..... *G09G 3/2003* (2013.01); *G09G 3/3614* (2013.01); *G09G 3/3648* (2013.01); *G09G 3/3674* (2013.01); *G09G 3/3677* (2013.01); *G09G 3/3685* (2013.01); *G09G 3/3688* (2013.01); *G09G 2300/0426* (2013.01); *G09G 2310/027* (2013.01); *G09G 2310/0289* (2013.01); *G09G 2310/063* (2013.01); *G09G 2310/08* (2013.01); *G09G 2320/0233* (2013.01); *G09G 2320/0242* (2013.01)

(58) Field of Classification Search
CPC ..... G09G 3/2003; G09G 3/3674
USPC ..... 345/67, 691
See application file for complete search history.

(56) References Cited

U.S. PATENT DOCUMENTS 8,217,875 B2 * 7/2012 Park ..... G09G 3/3611 345/690
8,884,995 B2 * 11/2014 Kwak ..... G09G 3/2003 345/690
2008/0012842 A1 1/2008 Mori
2008/0198120 A1 * 8/2008 Senda ..... G09G 3/3648 345/92
2014/0168187 A1 * 6/2014 Qu ..... G09G 3/20 345/212

(Continued)

FOREIGN PATENT DOCUMENTS

KR 10-0848552 7/2008

*Primary Examiner* — Calvin C Ma
(74) *Attorney, Agent, or Firm* — F. Chau & Associates, LLC

(57) ABSTRACT

A display apparatus includes a display panel, a first driver and a second driver. The display panel includes a plurality of gate lines and a plurality of data lines. The display panel is configured to display an image based on input image data. The first driver is configured to output compensating gate signals having the same timing to the gate lines during a first period and scan gate signals having different timings to the gate lines during a second period. The second driver is configured to apply a compensating data voltage corresponding to a compensating grayscale value to the data lines during the first period and a target data voltage corresponding to a target grayscale value to the data lines during the second period.

23 Claims, 21 Drawing Sheets

(56) References Cited

U.S. PATENT DOCUMENTS

2016/0063914 A1* 3/2016 Lee ..... G09G 3/3648
345/211

* cited by examiner

DISPLAY APPARATUS AND METHOD OF DRIVING DISPLAY PANEL USING THE SAME

CLAIM OF PRIORITY

This application claims priority under 35 U.S.C. § 119 from Korean Patent Application No. 10-2017-0052465, filed on Apr. 24, 2017 in the Korean Intellectual Property Office KIPO, the contents of which are incorporated by reference herein.

TECHNICAL FIELD

Embodiments of the present inventive concept relate to a display apparatus and a method of driving a display panel using the display apparatus. More particularly, embodiments of the present inventive concept relate to a display apparatus that increases a display quality of a display panel and a method of driving a display panel using the display apparatus.

DISCUSSION OF THE RELATED ART

Generally, a display apparatus includes a display panel and a display panel driver. The display panel includes, for example, a plurality of gate lines, a plurality of data lines and a plurality of pixels. The display panel driver includes a gate driver providing gate signals to the gate lines and a data driver providing data voltages to the data lines.

When a waveform of the data voltage repeatedly increases and decreases and a falling timing (e.g. fall time, a time it takes to transition to a low logic level) of the data voltage is delayed, the display panel may display an undesirable color. In addition, according to an increase of a resolution of the display panel and an increase of a driving frequency of the display apparatus, a horizontal cycle for applying the data voltage to the pixel may be decreased. Thus, the display defect may worsen.

SUMMARY

Embodiments of the present inventive concept provide a display apparatus applying a compensating grayscale value to data lines during a blank period to enhance a display quality of a display panel.

Embodiments of the present inventive concept also provide a method of driving a display panel using the display apparatus.

In an embodiment of a display apparatus according to the present inventive concept, the display apparatus includes a display panel, a first driver and a second driver. The display panel includes a plurality of gate lines and a plurality of data lines. The display panel is configured to display an image based on input image data. A first driver is configured to output to the gate lines compensating gate signals having a same timing during a first period and to output scan gate signals having different timings to the gate lines during a second period. A second driver is configured to apply a respective compensating data voltage to the data lines corresponding to a compensating grayscale value during the first period, and to apply one or more target data voltages to the data lines corresponding to one or more target grayscale values during the second period. The target grayscale values correspond to one or more pixels of the display panel.

According to an embodiment of the inventive concept, the first period includes a blank period and the second period includes an active period, wherein the different timings of the outputted scan gate signals in the active period are sequential, and wherein the same timing of the outputted compensating gate signals are simultaneous.

According to an embodiment of the inventive concept, the second driver includes a timing controller, and the active period includes a precharge period and a main charge period, and wherein the first driver applies the scan gate signals during the precharge period and the main charge period, and wherein the second driver is configured to output precharge data voltages to the data lines during the precharge period and output the target data voltages corresponding to the target data grayscale values to the data lines during the main charge period.

In an embodiment, the data line may be floated by the second driver when the target grayscale value is equal to the compensating grayscale value during the second period.

In an embodiment, the second driver includes a buffer configured to output the target data voltage to the data line, a comparator configured to determine whether the target grayscale value is equal to the compensating grayscale value and a data switch configured to block connection between the buffer and the data line when the target grayscale value is equal to the compensating grayscale value.

In an embodiment, the compensating grayscale value may be zero gray.

In an embodiment, the compensating grayscale value may be less than a medium grayscale value which is an average of a maximum grayscale value and zero gray.

In an embodiment, the compensating grayscale value may be a most frequent grayscale value among all of the target grayscale values corresponding to all of the target data voltages applied to all of the data lines in the second period.

In an embodiment, the display panel may include pixels disposed in a plurality of pixel rows. The pixels disposed in the pixel row may represent the same color.

In an embodiment, pixels disposed in a first pixel row among the pixel rows may be connected to a first gate line, the pixels disposed in the first pixel row may represent a first color. Pixels disposed in a second pixel row among the pixel rows may be connected to a second gate line, the pixels disposed in the second pixel row may represent a second color. Pixels disposed in a third pixel row among the pixel rows are connected to a third gate line, the pixels disposed in the third pixel row may represent a third color. Pixels disposed in a fourth pixel row among the pixel rows may be connected to a fourth gate line, the pixels disposed in the fourth pixel row may represent the first color. Pixels disposed in a fifth pixel row among the pixel rows may be connected to a fifth gate line, the pixels disposed in the fifth pixel row may represent the second color. Pixels disposed in a sixth pixel row among the pixel rows may be connected to a sixth gate line, the pixels disposed in the sixth pixel row may represent the third color.

In an embodiment, when the input image data is a single color image displaying only one of a first color, a second color and a third color in the second period or when the input image data is a mixed color image displaying only two of the first color, the second color and the third color in the second period, the first driver may output the compensating gate signals having the same driving timing in the first period. When the input image data is not the single color image and the mixed color image, the first driver may not output the compensating gate signals in the first period.

In an embodiment, the first driver may be configured to generate the compensating gate signals and the scan gate signals based on a plurality of clock signals. An input part of the first driver may include a first group of clock switches disposed on clock applying lines to apply the clock signals to the first driver and a second group of clock switches connected between the adjacent clock applying lines.

In an embodiment, during the first period, all of the first group of the clock switches may be turned off and all of the second group of the clock switches may be turned on. During the second period, all of the first group of the clock switches may be turned on and all of the second group of the clock switches may be turned off.

In an embodiment, an output part of the first driver may include a first group of gate switches disposed on the gate lines and a second group of gate switches connected between the adjacent gate lines.

In an embodiment, during the first period, all of the first group of the gate switches may be turned off and all of the second group of the gate switches may be turned on. During the second period, all of the first group of the gate switches may be turned on and all of the second group of the gate switches may be turned off.

In an embodiment, the second period may include a precharge period and a main charge period. The first driver may be configured to output the scan gate signals to the gate lines during the precharge period and the main charge period. The second driver may be configured to apply a precharge data voltage to the data lines during the precharge period and the target data voltage to the data lines during the main charge period.

In an embodiment of a method of driving a display panel according to the present inventive concept, the method includes outputting compensating gate signals to a plurality of gate lines during a first period of time, applying a compensating data voltage corresponding to a compensating grayscale value to a plurality of data lines during the first period, outputting scan gate signals to the gate lines during a second period of time, and applying a target data voltage corresponding to a target grayscale value to the data lines during the second period.

In an embodiment, the data line may be floated when the target grayscale value is equal to the compensating grayscale value during the second period.

In an embodiment, when the input image data is a single color image displaying only one color from among a first color, a second color and a third color in the second period, or when the input image data is a mixed color image displaying only two of the first color, the second color and the third color in the second period, the compensating gate signals having a same driving timing may be outputted to the gate lines in the first period. When the input image data is not the single color image and the mixed color image such as discussed above, the compensating gate signals may not be outputted to the gate lines during the first period.

In an embodiment, the compensating gate signals and the scan gate signals may be generated based on a plurality of clock signals by a first driver. An input part of the first driver may include a first group of clock switches disposed on clock applying lines to apply the clock signals to the first driver and a second group of clock switches connected between the adjacent clock applying lines.

In an embodiment, during the first period, all of the first group of the clock switches may be turned off and all of the second group of the clock switches may be turned on. During the second period, all of the first group of the clock switches may be turned on and all of the second group of the clock switches may be turned off.

In an embodiment, the compensating gate signals and the scan gate signals may be generated based on a plurality of clock signals by a first driver. An output part of the first driver may include a first group of gate switches disposed on the gate lines and a second group of gate switches connected between the adjacent gate lines. During the first period, all of the first group of the gate switches may be turned off and all of the second group of the gate switches may be turned on. During the second period, all of the first group of the gate switches may be turned on and all of the second group of the gate switches may be turned off.

According to the display apparatus and the method of driving the display panel using the display apparatus, the compensating grayscale value is applied to the data lines during the blank period and the data lines connected to the pixels having the target grayscale value same as the compensating grayscale value are floated instead of applying the target grayscale value. Accordingly, the toggling of the data voltage applied to the data line may be reduced. Thus, the display defect which displays an undesirable color on the display panel due to the delay of the falling timing of the data voltage may be reduced. Therefore, the display quality of the display panel may be enhanced.

BRIEF DESCRIPTION OF THE DRAWINGS

The above and other features and benefits of the present inventive concept will become better-appreciated by a person of ordinary skill in the art in view of detailed embodiments discussed herein below with reference to the accompanying drawings, in which.

DETAILED DESCRIPTION

Hereinafter, the present inventive concept will be explained in more detail with reference to the accompanying drawings.

Figure 1:
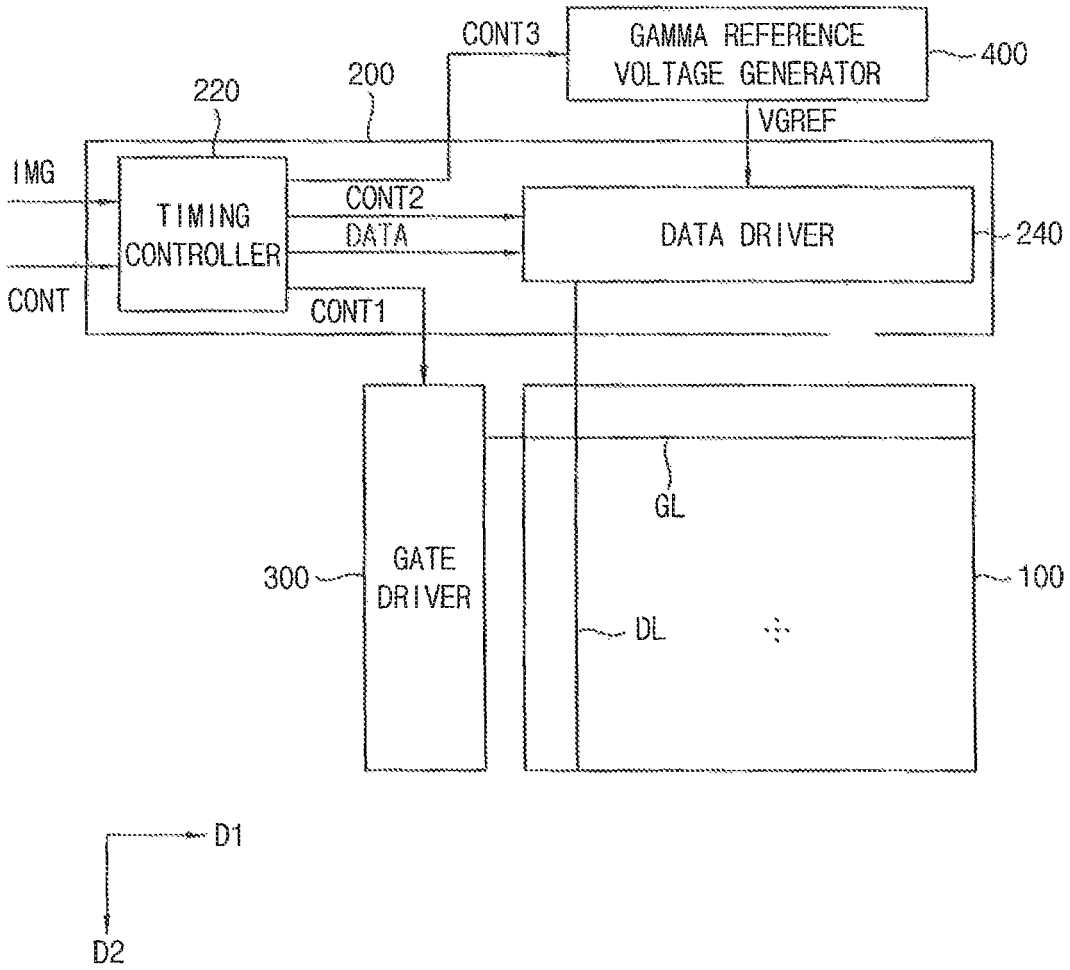
FIG. 1 is a block diagram illustrating the structure of a display apparatus according to an embodiment of the present inventive concept.

FIG. 1 is a block diagram illustrating a display apparatus according to an embodiment of the present inventive concept.

Referring to FIG. 1, the display apparatus includes a display panel 100 and a display panel driver. The display panel driver includes a first driver 300, a second driver 200 and a gamma reference voltage generator 400. The first driver 300 may include a gate driver. The second driver 200 may include a timing controller 220 and a data driver 240. For example, the second driver 200 may be formed in a single chip. The second driver 200 may be a timing controller embedded data driver (TED) chip.

The display panel 100 has a display region on which an image is displayed and a peripheral region adjacent to the display region.

The display panel 100 includes a plurality of gate lines GL, a plurality of data lines DL and a plurality of pixels electrically connected to the gate lines GL and the data lines DL. The gate lines GL extend in a first direction D1 and the data lines DL extend in a second direction D2 crossing the first direction D1.

Each pixel includes a switching element (not shown), a liquid crystal capacitor (not shown) and a storage capacitor (not shown). The liquid crystal capacitor and the storage capacitor are electrically connected to the switching element. The pixels may be arranged in a matrix form.

Figure 2:
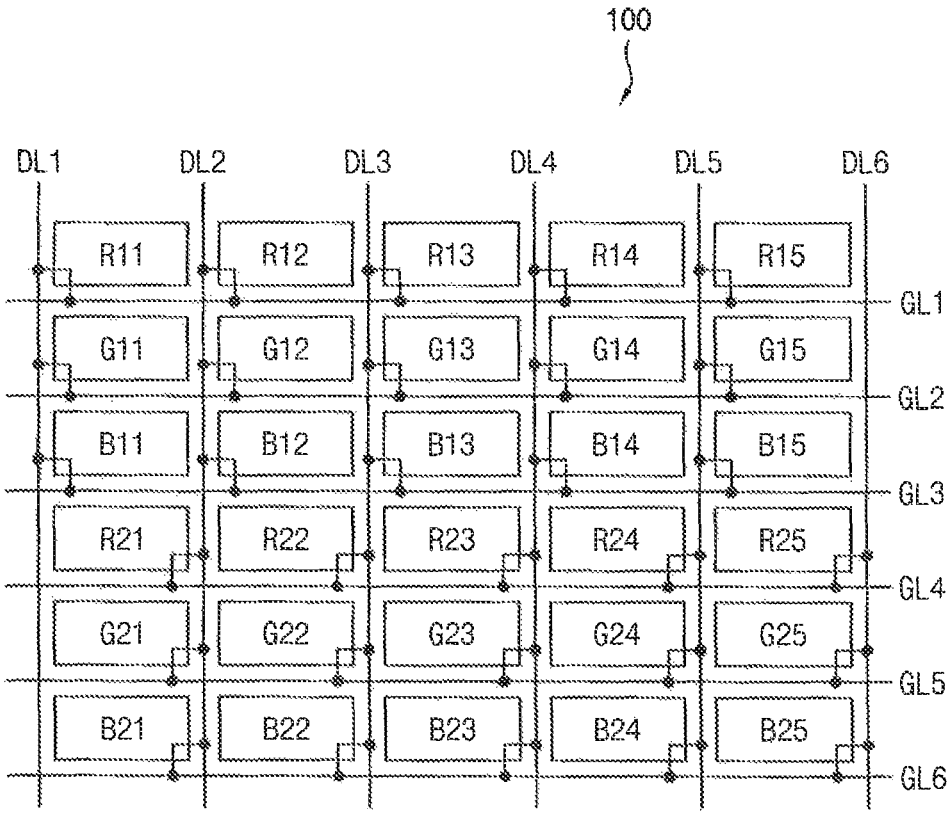
FIG. 2 is a conceptual diagram illustrating an example of display panel of a display apparatus such as shown in FIG. 1.
Figure 3A:
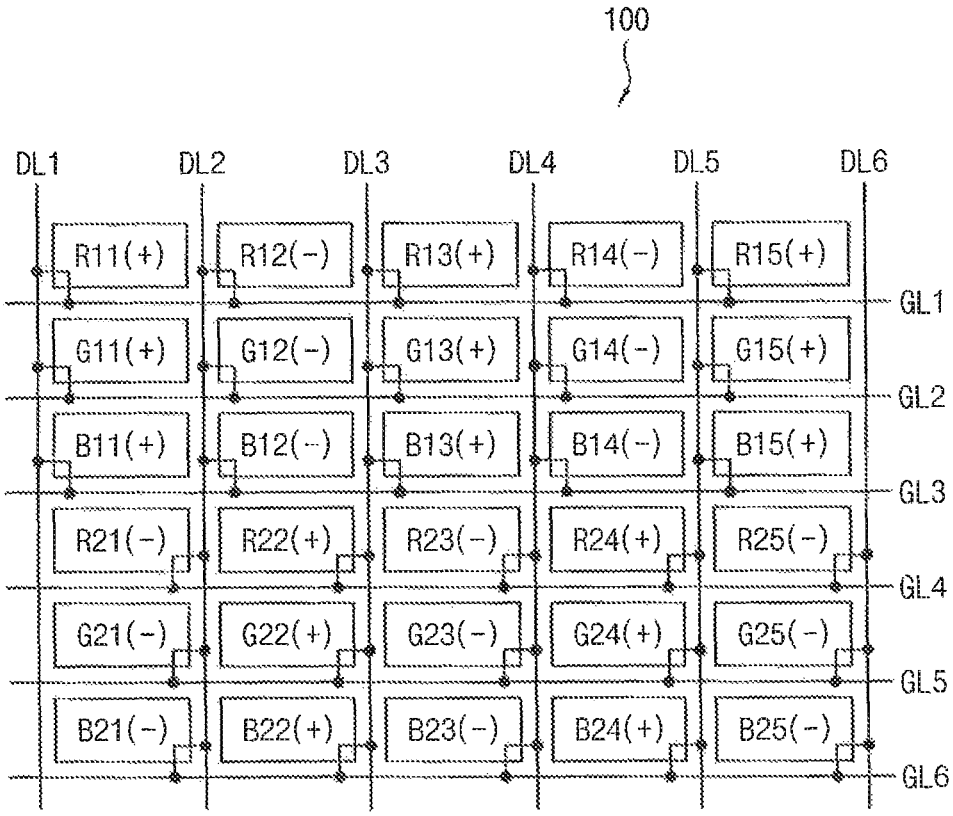
FIGS. 3A and 3B are conceptual diagrams illustrating a method of driving the display panel of FIG. 2.
Figure 3B:
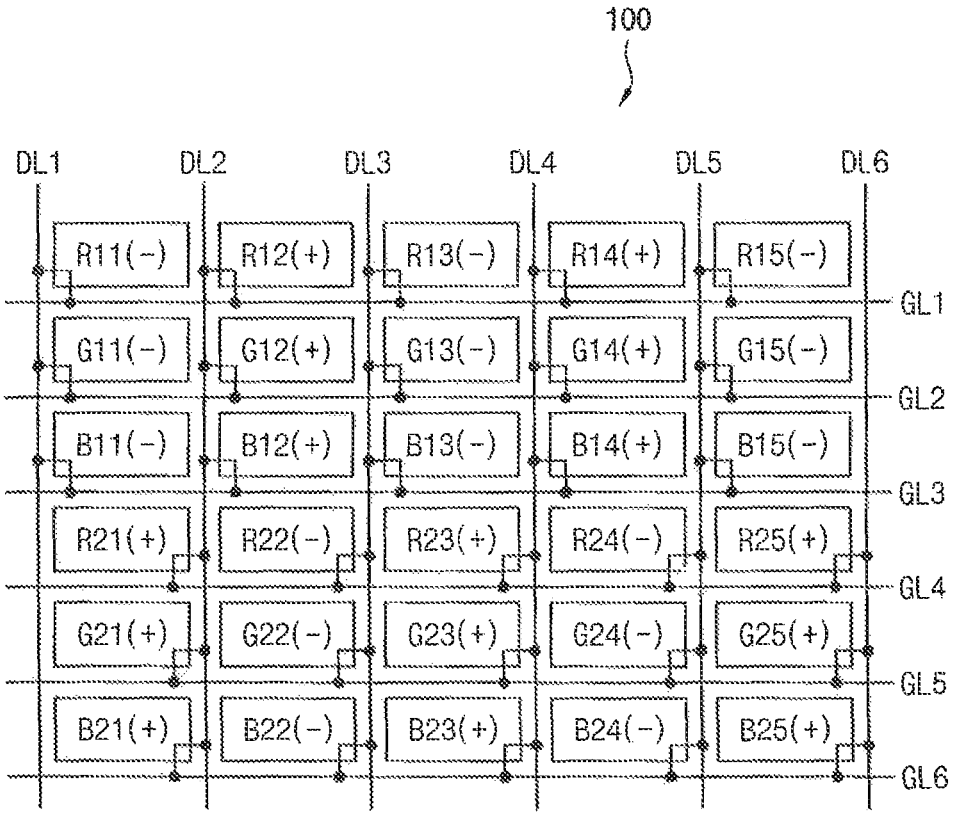

The structure of the display panel 100 is discussed referring to FIGS. 2 to 3B in detail.

The timing controller 220 receives input image data IMG and an input control signal CONT from an external apparatus (not shown). The input image data may include, for example, red image data, green image data and blue image data. The input control signal CONT may include a master clock signal and a data enable signal. The input control signal CONT may include a vertical synchronizing signal and a horizontal synchronizing signal.

The timing controller 220 generates a first control signal CONT1, a second control signal CONT2, a third control signal CONT3 and a data signal DATA based on the input image data IMG and the input control signal CONT.

The timing controller 220 generates the first control signal CONT1 for controlling an operation of the gate driver 300 based on the input control signal CONT, and outputs the first control signal CONT1 to the gate driver 300. The first control signal CONT1 may further include, for example, a vertical start signal and a gate clock signal.

The timing controller 220 generates the second control signal CONT2 for controlling an operation of the data driver 240 based on the input control signal CONT, and outputs the second control signal CONT2 to the data driver 240. The second control signal CONT2 may include, for example, a horizontal start signal and a load signal.

The timing controller 220 also generates the data signal DATA based on the input image data IMG. The timing controller 220 outputs the data signal DATA to the data driver 240.

The timing controller 220 also generates the third control signal CONT3 that may control an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the timing controller 220. The gate driver 300 may sequentially output the gate signals to the gate lines GL. There may be, for example, a plurality of gate lines $GL_1$ to $GL_x$ (not shown) and a plurality of data lines $DL_1$ to $DL_y$ (not shown) represented by GL and DL, respectively.

An input part and an output part of the gate driver 300 will be explained subsequently in the discussion of FIGS. 13A and 13B.

With continued reference to FIG. 1, the gamma reference voltage generator 400 generates a gamma reference voltage VGREF in response to the third control signal CONT3 received from the timing controller 220. The gamma reference voltage generator 400 provides the gamma reference voltage VGREF to the data driver 240. The gamma reference voltage VGREF has a value corresponding to a level of the data signal DATA.

The gamma reference voltage generator 400 may be disposed in the second driver 200. For example, the gamma reference voltage generator 400 may be arranged along with the timing controller 220, or in the data driver 240.

The data driver 240 receives the second control signal CONT2 and the data signal DATA from the timing controller 220, and receives the gamma reference voltages VGREF from the gamma reference voltage generator 400. In response to receiving the control signals and the data signals, the data driver 240 converts the data signal DATA into data voltages having an analog type using the gamma reference voltages VGREF. The data driver 240 outputs the data voltages to the data lines DL.

The structure and the operation of the data driver 240 are explained in more detail subsequently with reference to FIG. 11.

FIG. 2 is a conceptual diagram illustrating the display panel 100 of FIG. 1. FIGS. 3A and 3B are conceptual diagrams illustrating a method of driving the display panel 100 of FIG. 2.

Referring to FIG. 2, the display panel 100 includes a plurality of pixels disposed in a plurality of pixel rows and a plurality of pixel columns. In this example, the pixel rows may be different rows of colors, such as rows of red, rows of blue, and rows of green.

The pixels disposed in a single pixel row may be connected to a single gate line. For example, the pixels R11, R12, R13, R14 and R15 disposed in a first pixel row are connected to a first gate line GL1. The pixels G11, G12, G13, G14 and G15 disposed in a second pixel row are connected to a second gate line GL2. The pixels B11, B12, B13, B14 and B15 disposed in a third pixel row are connected to a third gate line GL3. The pixels R21, R22, R23, R24 and R25 disposed in a fourth pixel row are connected to a fourth gate line GL4. The pixels G21, G22, G23, G24 and G25 disposed in a fifth pixel row are connected to a fifth gate line GL5. The pixels B21, B22, B23, B24 and B25 disposed in a sixth pixel row are connected to a sixth gate line GL6.

The pixels R11, R12, R13, R14 and R15 disposed in the first pixel row may represent a first color. The pixels G11, G12, G13, G14 and G15 disposed in the second pixel row may represent a second color. The pixels B11, B12, B13, B14 and B15 disposed in the third pixel row may represent a third color. A mixed color from the display of the first color, the second color and the third color may represent white. For example, one of the first color, the second color and the third color may be red, green or blue. For example, the first color may be red, the second color may be green and the third color may be blue.

The pixels R21, R22, R23. R24 and R25 disposed in the fourth pixel row may represent the first color. The pixels G21, G22, G23, G24 and G25 disposed in the fifth pixel row may represent the second color. The pixels B21, B22, B23, B24 and B25 disposed in the sixth pixel row may represent the third color. Therefore, in this example, there may be a sequence of different colored rows that repeat.

In addition, the pixels disposed in a single pixel column may be alternately connected to two adjacent data lines disposed on respectively opposite sides of the pixel column. For example, the pixels disposed in the single pixel column may be alternately connected to two adjacent data lines disposed on the respective sides of the pixel column in a unit of three pixels.

For example, referring to FIG. 2, the pixels R11, G11, B11, R21, G21 and B21 disposed in a first pixel column are alternately connected to a first data line DL1 and a second data line DL2 in a unit of three pixels. For example, first to third pixels R11, G11 and B11 disposed in the first pixel column are connected to the first data line DL1 and fourth to sixth pixels R21, G21 and B21 disposed in the first pixel column are connected to the second data line DL2.

With further reference to FIG. 2, for example, the pixels R12, G12, B12, R22, G22 and B22 disposed in a second pixel column are alternately connected to the second data line DL2 and a third data line DL3 in a unit of three pixels. For example, first to third pixels R12, G12 and B12 disposed in the second pixel column are connected to the second data line DL2 and fourth to sixth pixels R22, G22 and B22 disposed in the second pixel column are connected to the third data line DL3.

With continued reference to FIG. 2, for example, the pixels R13, G13, B13, R23, G23 and B23 disposed in a third pixel column are alternately connected to the third data line DL3 and a fourth data line DL4 in a unit of three pixels. For example, first to third pixels R13, G13 and B13 disposed in the third pixel column are connected to the third data line DL3 and fourth to sixth pixels R23, G23 and B23 disposed in the second pixel column are connected to the fourth data line DL4.

The fourth pixel column has respective connections to DL4 and DL5 and the fifth pixel column shown has respective connections to DL5 and DL6 in units of three pixels similar to the other pixel columns shown in FIG. 2 (e.g. pixel groups in units of three R14, G14, B14, and R24, G24 and B24 in column 4, and units R15, G15 and B15, and R25, G25 and B25).

FIG. 3A is a conceptual diagram illustrating polarities of data voltages of the pixels of the display panel 100 during a first frame.

Referring to FIG. 3A, the data voltages applied to a single data line may be alternately applied to two adjacent pixel columns in a unit of three pixels. The data voltage applied to the single data line may have the same polarity.

For example, the data voltages applied to the first data line DL1 may be applied to the pixels R11, G11 and B11. The data voltages applied to the second data line DL2 may be applied to the pixels R12, G12, B12, R21, G21 and B21. The data voltages applied to the third data line DL3 may be applied to the pixels R13, G13, B13, R22, G22 and B22. The data voltages applied to the fourth data line DL4 may be applied to the pixels R14, G14, B14, R23, G23 and B23.

With continued reference to FIG. 3A, the data voltages applied to the first data line DL1, the third data line DL3 and the fifth data line DL5 may have a positive polarity, whereas the data voltages applied to the second data line DL2, the fourth data line DL4 and a sixth data line DL6 may have a negative polarity. Thus, the positive data voltages are applied to the first to third pixels R11, G11 and B11 in the first pixel column. The negative data voltages are applied to the fourth to sixth pixels R21, G21 and B21 in the first pixel column. The negative data voltages are applied to the first to third pixels R12, G12 and B12 in the second pixel column. The positive data voltages are applied to the fourth to sixth pixels R22, G22 and B22 in the second pixel column.

FIG. 3B is a conceptual diagram illustrating polarities of data voltages of the pixels of the display panel 100 during a second frame. A brief comparison of FIG. 3B with FIG. 3A shows that the polarities of data voltages are reversed.

Referring to FIG. 3B, the data voltages applied to a single data line may be alternately applied to two adjacent pixel columns in a unit of three pixels. The data voltage applied to the single data line may have the same polarity. The data voltages applied to the data line in FIG. 3B may have a polarity opposite to the polarity of the data voltages applied to the same data line in FIG. 3A.

For example, in FIG. 3B, the data voltages applied to the first data line DL1, the third data line DL3 and the fifth data line DL5 may have a negative polarity and the data voltages applied to the second data line DL2, the fourth data line DL4 and the sixth data line DL6 may have a positive polarity. Thus, the negative data voltages are applied to the first to third pixels R11, G11 and B11 in the first pixel column. The positive data voltages are applied to the fourth to sixth pixels R21, G21 and B21 in the first pixel column. The positive data voltages are applied to the first to third pixels R12, G12 and B12 in the second pixel column. The negative data voltages are applied to the fourth to sixth pixels R22, G22 and B22 in the second pixel column.

As a result, the display panel 100 is driven in a column inversion method in a viewpoint of the data lines and the display panel 100 is driven in a 3-by-1 dot inversion method in a viewpoint of the pixels.

Although the pixels in the single pixel column are alternately connected to two adjacent data lines disposed both sides of the pixel column in a unit of three pixels in FIGS. 2 to 3B, the present inventive concept is not limited thereto. Alternatively, the pixels in the single pixel column are alternately connected to two adjacent data lines disposed on opposite sides of the same pixel column in a unit of a pixel or in a unit of two pixels. However, the pixels in the single pixel column may be connected, for example, to the data line disposed in a single side of the pixel column.

Although the pixels in six pixel rows and five pixel columns are illustrated in FIGS. 2 to 3B for convenience of explanation, a person of ordinary skill in the art should understand and appreciate that the display panel 100 may include more rows and columns of pixels than shown.

Figure 4A:
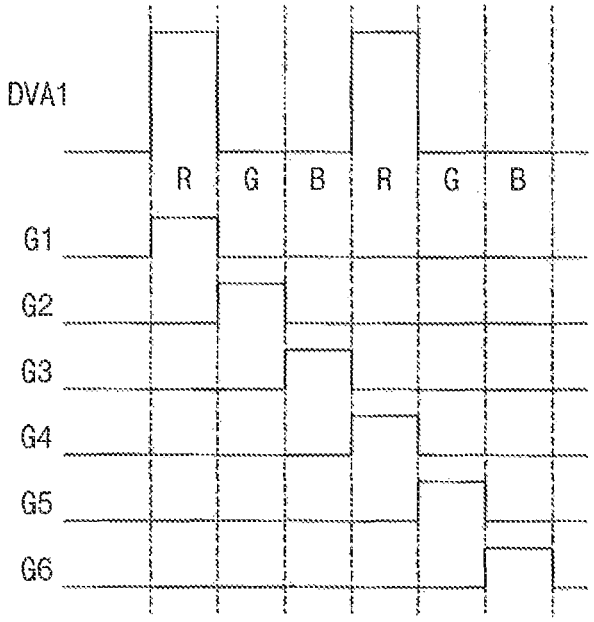
FIG. 4A is a waveform diagram illustrating a data voltage and a gate signal when the display panel of FIG. 2 represents a red image and a falling timing of the data voltage is not delayed.
Figure 4B:
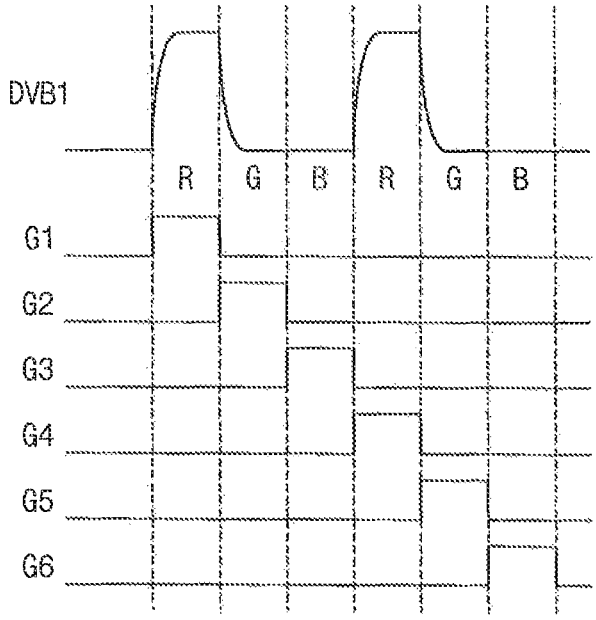
FIG. 4B is a waveform diagram illustrating the data voltage and the gate signal when the display panel of FIG. 2 represents the red image and the falling timing of the data voltage is delayed.

FIG. 4A is a waveform diagram illustrating a data voltage and a gate signal when the display panel 100 of FIG. 2 represents a red image and a falling timing (e.g. fall time) of the data voltage is not delayed. FIG. 4B is a waveform diagram illustrating the data voltage and the gate signal when the display panel 100 of FIG. 2 represents the red image and the falling timing (e.g. fall time) of the data voltage is delayed.

Referring to FIGS. 1, 2, 3A, 3B, 4A and 4B, for example, the display panel 100 displays a red image.

For example, data voltages DVA1 and DVB1 in FIGS. 4A and 4B may be the data voltage applied to the second data line DL2 in FIG. 3B. First to sixth gate signals G1 to G6 in FIGS. 4A and 4B may be the gate signal applied to the first to sixth gate lines GL1 to GL6 in FIG. 3B.

In FIG. 4A, the falling timing (e.g., fall time) of the data voltage DVA1 may not be delayed. FIG. 4A may represent an ideal example. Alternatively, FIG. 4A may represent an example of the display apparatus including liquid crystal molecules which have a very high response speed. According to FIG. 4A, the red pixel R12 (FIG. 3B) represents a red grayscale value R in response to the first gate signal G1 and the red pixel R21 represents a red grayscale value R in response to the fourth gate signal G4.

In FIG. 4A, the falling timing of the data voltage DVA1 is not delayed so that the display panel 100 may represent a desirable image.

In contrast, in FIG. 4B, the falling timing (e.g., fall time) of the data voltage DVB1 may be delayed. FIG. 4B may represent a practical example of the display apparatus including liquid crystal molecules which do not have a very high response speed. According to FIG. 4B, the red pixel R12 represents a red grayscale value R in response to the first gate signal G1 and the red pixel R21 represents a red grayscale value R in response to the fourth gate signal G4. However, in this case, the green pixel G12 may represent an undesirable green grayscale value G in response to the second gate signal G2. In addition, the green pixel G21 may represent an undesirable green grayscale value G in response to the fifth gate signal G5. Thus, a dark red color of the red pixels R12 and R21 and a light green color of the green pixels G12 and G21 may be mixed so that the pixels R12, R21, G12 and G21 may represent orange.

In FIG. 4B, the fall time of the data voltage DVB1 is delayed so that the display panel 100 may not represent a desirable image. In other words, the images to be displayed may have ideally been intended to be red, and the display of the orange color display is undesired and a result of a less-than-ideal square wave for data voltage DVB1 applied to pixels.

Figure 5A:
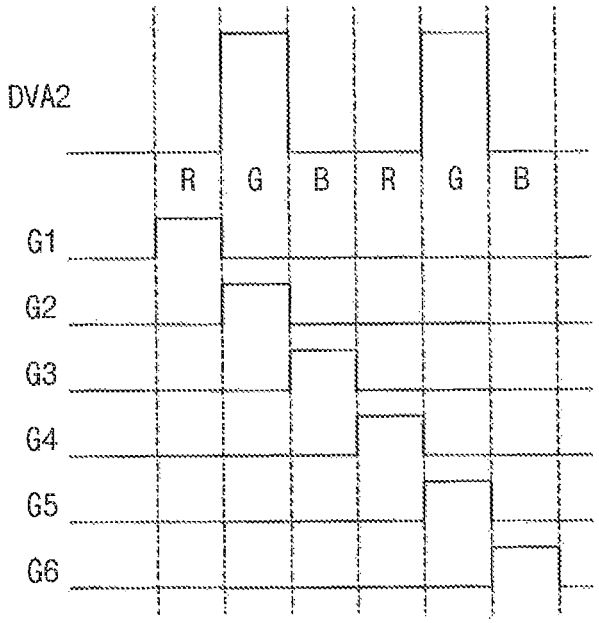
FIG. 5A is a waveform diagram illustrating the data voltage and the gate signal when the display panel of FIG. 2 represents a green image and a falling timing of the data voltage is not delayed.
Figure 5B:
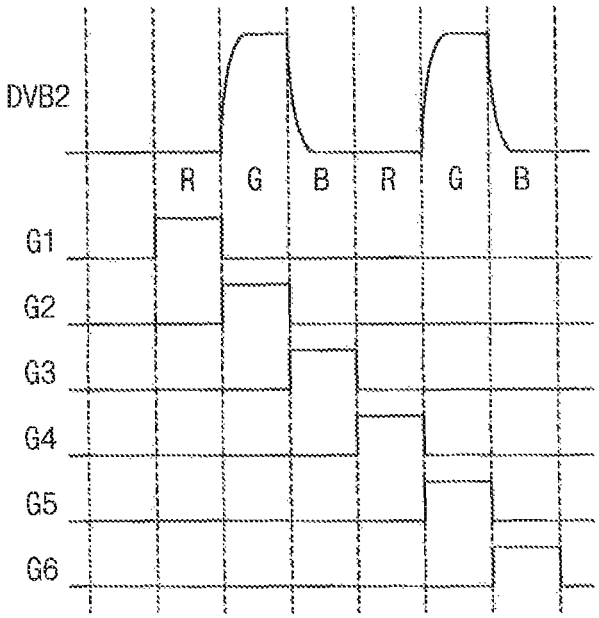
FIG. 5B is a waveform diagram illustrating the data voltage and the gate signal when the display panel of FIG. 2 represents the green image and the falling timing of the data voltage is delayed.

FIG. 5A is a waveform diagram illustrating the data voltage and the gate signal when the display panel 100 of FIG. 2 represents a green image and a falling timing of the data voltage is not delayed. FIG. 5B is a waveform diagram illustrating the data voltage and the gate signal when the display panel 100 of FIG. 2 represents the green image and the falling timing of the data voltage is delayed.

Referring to FIGS. 1 to 5B, for example, the display panel 100 displays a green image.

In FIG. 5A, the fall time (falling timing) of the data voltage DVA1 may not be delayed. FIG. 5A may represent an ideal example. Alternatively, FIG. 5A may represent an example of the display apparatus including liquid crystal molecules which have a very high response speed. According to FIG. 5A, the green pixel G12 represents a green grayscale value G in response to the second gate signal G2 and the green pixel G21 represents a green grayscale value G in response to the fifth gate signal G5.

In FIG. 5A, the falling timing of the data voltage DVA2 is not delayed so that the display panel 100 may represent a desirable image.

In contrast, in FIG. 5B, the falling timing of the data voltage DVB2 may be delayed. In fact, similar to DVB1, it can be seen from DVB2 that both the rise time and fall time is not that of an ideal square wave, but it is the delayed fall time that may cause an undesirable image. FIG. 5B may represent a practical example of the display apparatus including liquid crystal molecules which does not have a very high response speed. According to FIG. 5B, the green pixel G12 represents a green grayscale value G in response to the second gate signal G2 and the green pixel G21 represents a green grayscale value G in response to the fifth gate signal G5. However, in this case, the blue pixel B12 may represent an undesirable blue grayscale value B in response to the third gate signal G3. In addition, the blue pixel B21 may represent an undesirable blue grayscale value B in response to the sixth gate signal G6.

In FIG. 5B, the falling timing of the data voltage DVB2 is delayed so that the display panel 100 may not represent a desirable image.

Figure 6A:
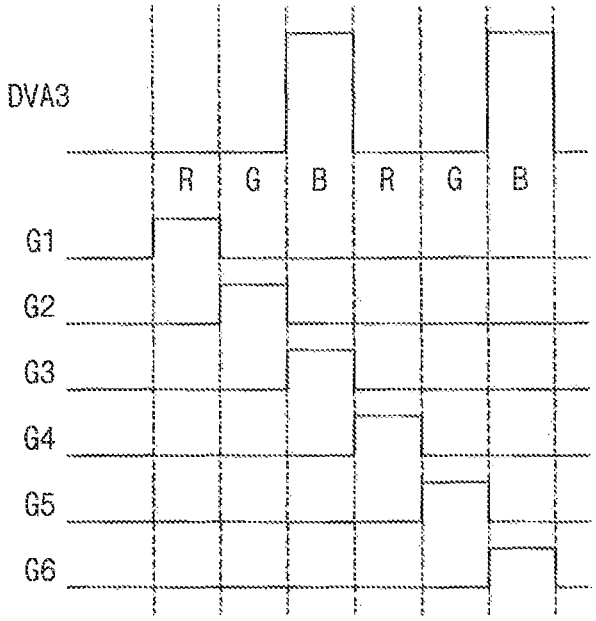
FIG. 6A is a waveform diagram illustrating the data voltage and the gate signal when the display panel of FIG. 2 represents a blue image and a falling timing of the data voltage is not delayed.
Figure 6B:
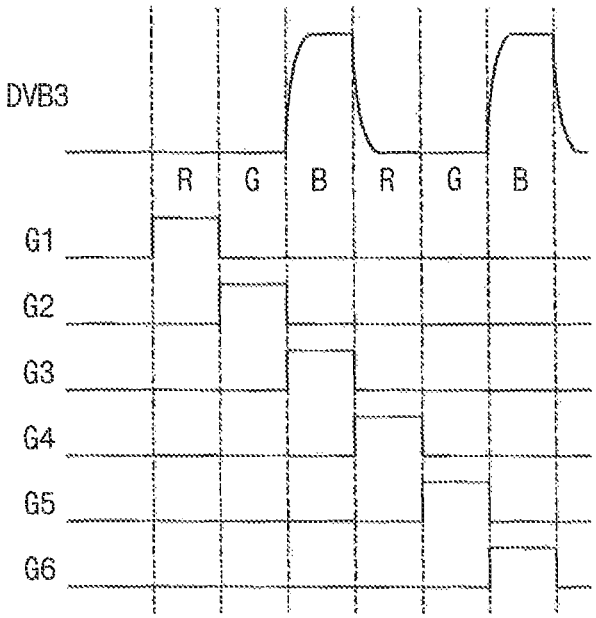
FIG. 6B is a waveform diagram illustrating the data voltage and the gate signal when the display panel of FIG. 2 represents the blue image and the falling timing of the data voltage is delayed.

FIG. 6A is a waveform diagram illustrating the data voltage and the gate signal when the display panel 100 of FIG. 2 represents a blue image and a falling timing of the data voltage is not delayed. FIG. 6B is a waveform diagram illustrating the data voltage and the gate signal when the display panel 100 of FIG. 2 represents the blue image and the falling timing of the data voltage is delayed.

Referring to FIGS. 1 to 6B, for example, the display panel 100 displays a blue image.

In FIG. 6A, the falling timing of the data voltage DVA3 may not be delayed. FIG. 6A may represent an ideal example. Alternatively, FIG. 6A may represent an example of the display apparatus including liquid crystal molecules which have a very high response speed. According to FIG. 6A, the blue pixel B12 represents a blue grayscale value B in response to the third gate signal G3 and the blue pixel B21 represents a blue grayscale value B in response to the sixth gate signal G6.

In FIG. 6A, the falling timing of the data voltage DVA3 is not delayed so that the display panel 100 may represent a desirable image.

In contrast, in FIG. 6B, the falling timing of the data voltage DVB3 may be delayed and there can be a mixed color displayed of blue and red during the fall time of DVB3. FIG. 6B may represent a practical example of the display apparatus including liquid crystal molecules which does not have a very high response speed. According to FIG. 6B, the blue pixel B12 represents a blue grayscale value B in response to the third gate signal G3 and the blue pixel B21 represents a blue grayscale value B in response to the sixth gate signal G6. However, in this case, the red pixel R21 may represent an undesirable red grayscale value R in response to the fourth gate signal G4. In addition, the red pixel may represent an undesirable red grayscale value R in response to a seventh gate signal.

In FIG. 6B, the falling timing (e.g. fall time) of the data voltage DVB3 is delayed so that the display panel 100 may not represent a desirable image.

Figure 7A:
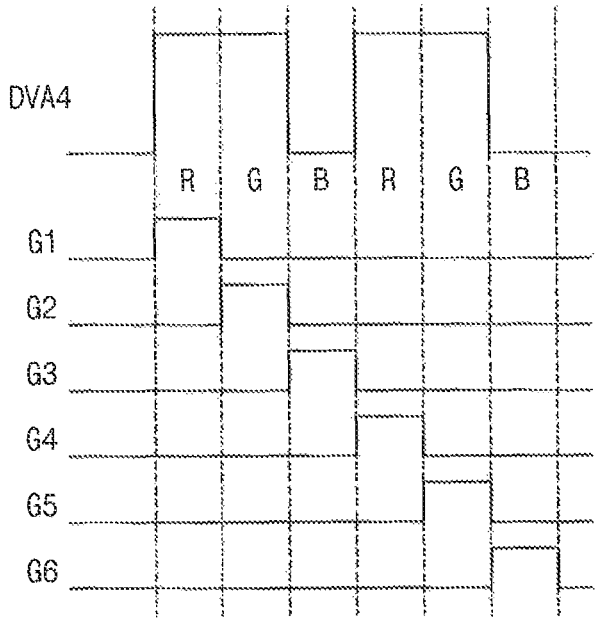
FIG. 7A is a waveform diagram illustrating the data voltage and the gate signal when the display panel of FIG. 2 represents a yellow image and a falling timing of the data voltage is not delayed.
Figure 7B:
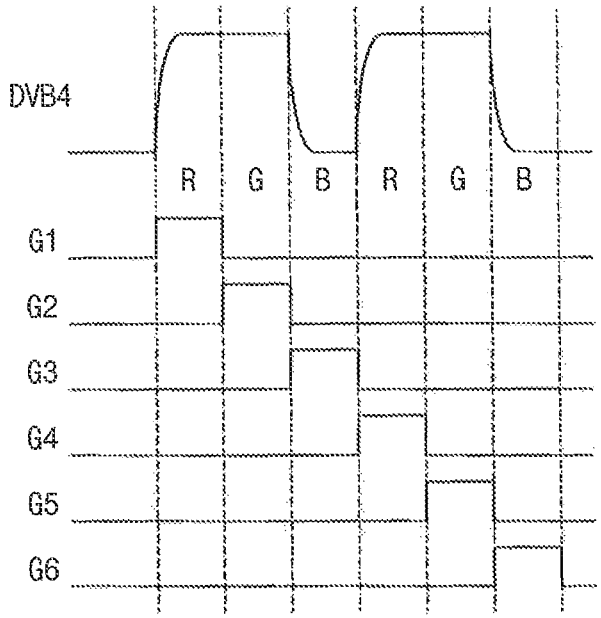
FIG. 7B is a waveform diagram illustrating the data voltage and the gate signal when the display panel of FIG. 2 represents the yellow image and the falling timing of the data voltage is delayed.

FIG. 7A is a waveform diagram illustrating the data voltage and the gate signal when the display panel 100 of FIG. 2 represents a yellow image and a falling timing of the data voltage is not delayed. FIG. 7B is a waveform diagram illustrating the data voltage and the gate signal when the display panel 100 of FIG. 2 represents the yellow image and the falling timing of the data voltage is delayed.

Referring to FIGS. 1 to 7B, for example, the display panel 100 displays a yellow image by providing data voltages to red and green pixels.

In FIG. 7A, the falling timing of the data voltage DVA4 may not be delayed. FIG. 7A may represent an ideal example. Alternatively, FIG. 7A may represent an example of the display apparatus including liquid crystal molecules which has a very high response speed. According to FIG. 7A, the red pixel R12 and the green pixel G12 respectively represent a red grayscale value R and a green grayscale value G in response to the first and second gate signals G1 and G2 and the red pixel R21 and the green pixel G21 respectively represent a red grayscale value R and a green grayscale value G in response to the fourth and fifth gate signals G4 and G5.

In FIG. 7A, the falling timing (fall time) of the data voltage DVA4 is not delayed so that the display panel 100 may represent a desirable image (e.g., in this case a yellow image).

In contrast, in FIG. 7B, the falling timing (fall time) of the data voltage DVB4 may be delayed. FIG. 7B may represent a practical example of the display apparatus including liquid crystal molecules which does not have a very high response speed. According to FIG. 7B, the red pixel R12 and the green pixel G12 respectively represent a red grayscale value R and a green grayscale value G in response to the first and second gate signals G1 and G2 and the red pixel R21 and the green pixel G21 respectively represent a red grayscale value R and a green grayscale value G in response to the fourth and fifth gate signals G4 and G5. However, in this case, the blue pixel B12 may represent an undesirable blue grayscale value B in response to the third gate signal G3. In addition, the blue pixel B21 may represent an undesirable blue grayscale value B in response to a sixth gate signal G6.

In FIG. 7B, the falling timing of the data voltage DVB4 is delayed so that the display panel 100 may not represent a desirable image, as the blue pixel may be displayed along with the red and the green. In such a case, there is no intent to have the blue pixel to be displayed.

Although the display panel 100 represents the yellow image which is the mixed image of the red image and the green image in FIGS. 7A and 7B, the display defect of the display panel 100 may be generated when the display panel 100 represent a magenta image which is the mixed image of the red image and the blue image or a cyan image which is the mixed image of the green image and the blue image.

Figure 8:
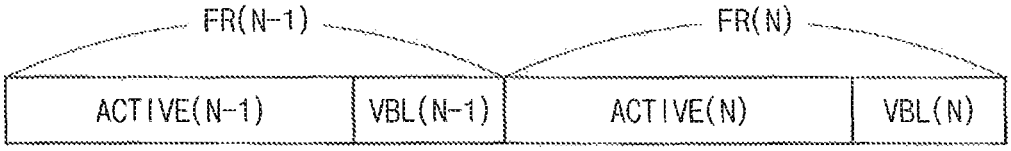
FIG. 8 is a conceptual diagram illustrating an active period and a blank period of a driving period of the display panel of FIG. 1.
Figure 9:
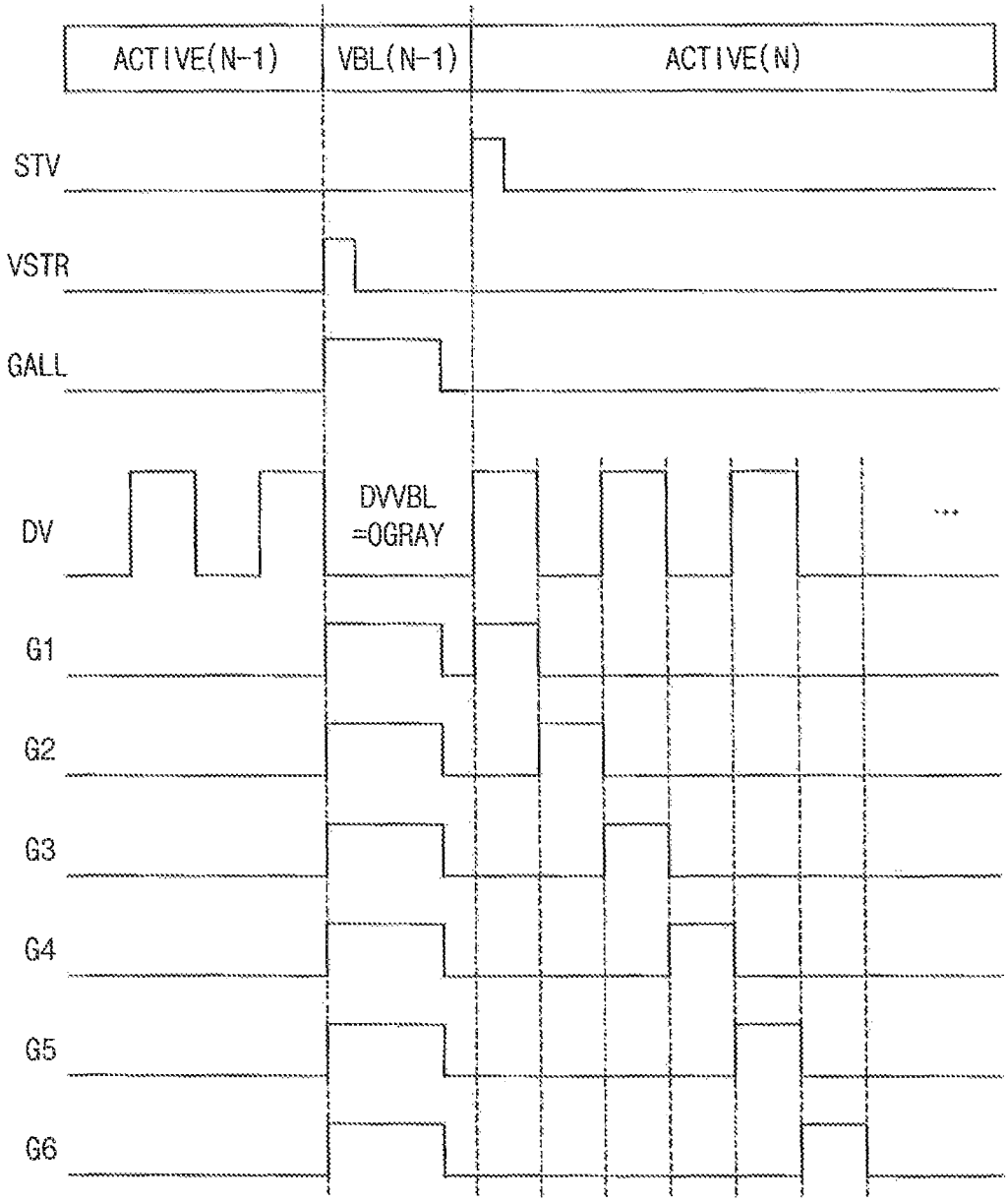
FIG. 9 is a waveform diagram illustrating signals representing the method of driving the display panel of FIG. 2.
Figure 10A:
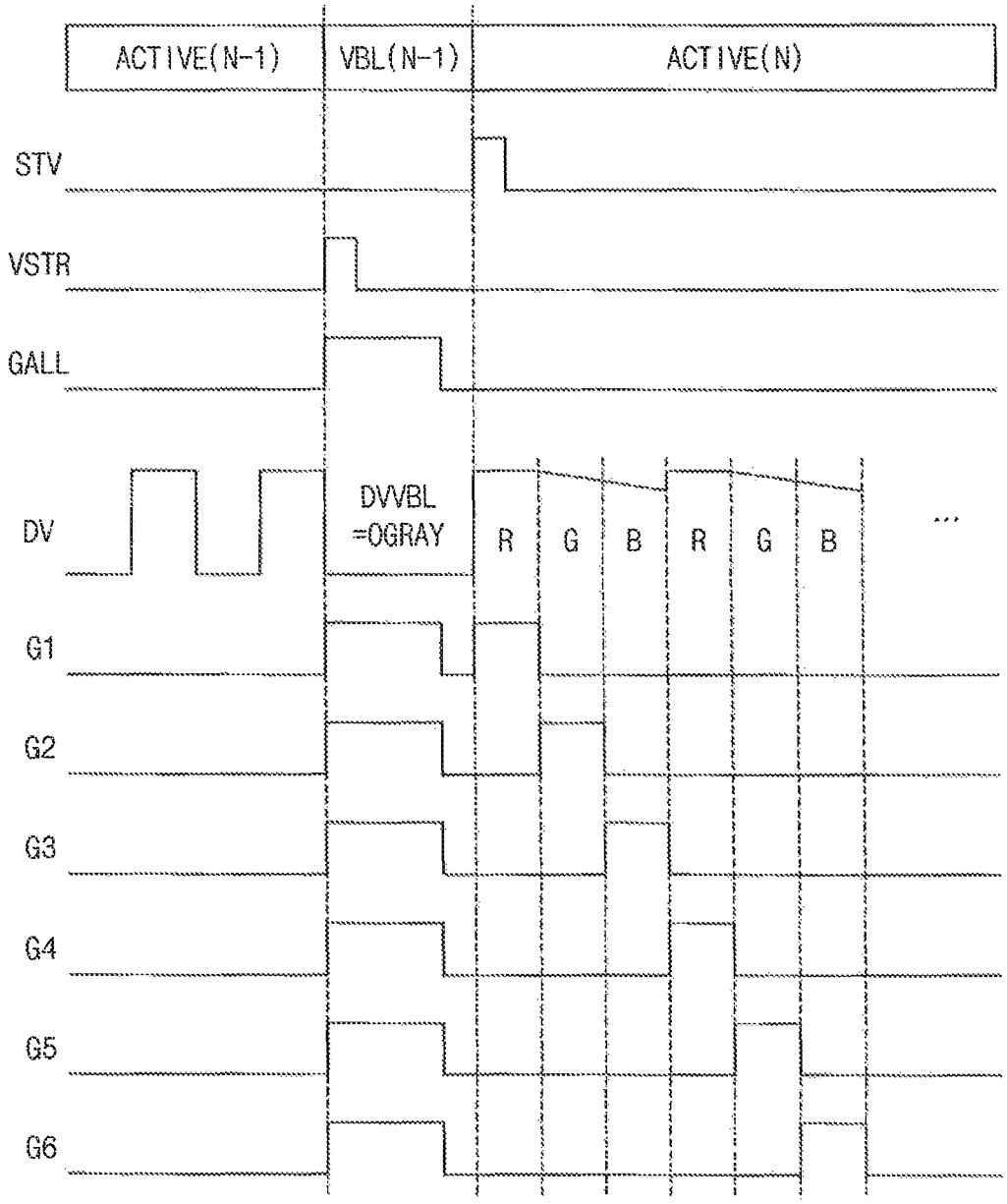
FIG. 10A is a waveform diagram illustrating signals representing the method of driving the display panel of FIG. 2 when the display panel of FIG. 2 represents the red image and a compensating grayscale value is zero gray.
Figure 10B:
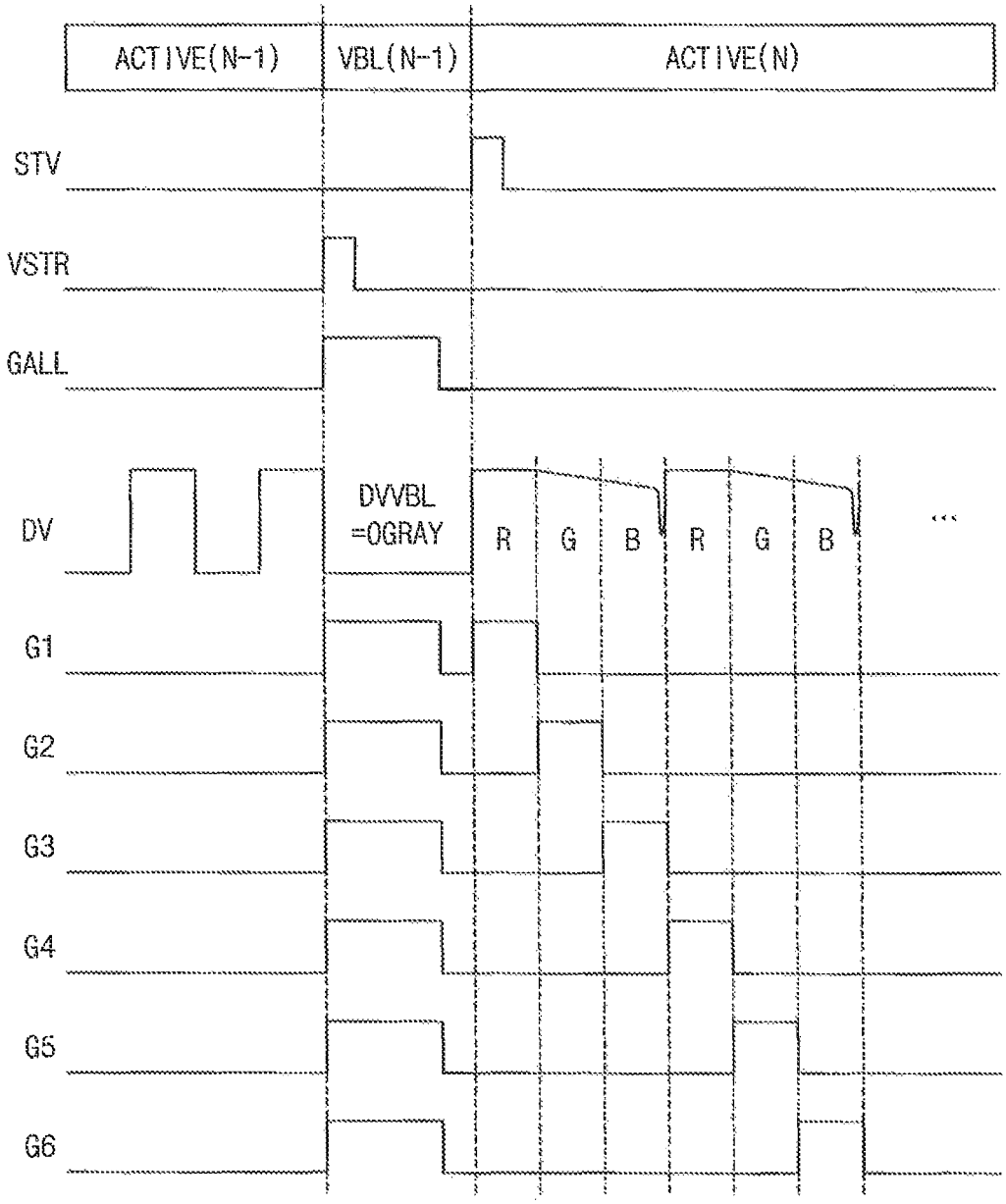
FIG. 10B is a waveform diagram illustrating signals representing the method of driving the display panel of FIG. 2 when the display panel of FIG. 2 represents the red image and the compensating grayscale value is zero gray.

FIG. 8 is a conceptual diagram illustrating an active period and a blank period of a driving period of the display panel 100 of FIG. 1. FIG. 9 is a waveform diagram illustrating signals representing the method of driving the display panel 100 of FIG. 2. FIG. 10A is a waveform diagram illustrating signals representing the method of driving the display panel 100 of FIG. 2 when the display panel 100 of FIG. 2 represents the red image and a compensating grayscale value is zero gray. FIG. 10B is a waveform diagram illustrating signals representing the method of driving the display panel 100 of FIG. 2 when the display panel 100 of FIG. 2 represents the red image and the compensating grayscale value is zero gray.

Referring to FIGS. 1 to 10B, the display panel 100 may display the image in a unit of frame. A single frame includes an active period and a blank period. For example, an (N−1)-th frame FR(N−1) may include an (N−1)-th active period ACTIVE(N−1) and an (N−1)-th blank period VBL (N−1). For example, an N-th frame FR(N) may include an N-th active period ACTIVE(N) and an N-th blank period VBL(N).

Although the frame includes the active period and the blank period for convenience of explanation, the frame may have a concept the same as the active period. In addition, although the blank period between the (N−1)-th active period ACTIVE(N−1) and the N-th active period ACTIVE (N) may be called to the (N−1)-th black period, the blank period VBL(N−1) between the (N−1)-th active period ACTIVE(N−1) and the N-th active period ACTIVE(N) may be called to the (N)-th black period VBL(N).

During the active period, scan gate signals having different timings may be applied to the gate lines. For example, during the active period, the scan gate signals may be sequentially applied to the scan gate lines.

During the blank period, compensating gate signals having the same timing may be applied to the gate lines. The term "same timing" may be understood by a person of ordinary skill in the art to mean that the compensating gate signals may be applied to the gate lines at substantially the time. For example, FIG. 9 shows that during the blank period, the gate signals G1 to G6 all receive a signal at substantially the same time, rather than in a substantially sequential manner, such as shown in the active period.

In FIG. 9, a vertical start signal STV is applied at the beginning of the active period. When the vertical start signal STV is applied to the gate driver, the first to sixth gate signals G1 to G6 are sequentially turned on.

Although in FIG. 9 the first gate signal G1 has a rising edge corresponding to a rising edge of the vertical start signal STV in FIG. 9, the present inventive concept is not limited thereto. Alternatively, the first gate signal G1 may have a rising edge corresponding to a falling edge of the vertical start signal STV.

In addition, although the waveforms of the gate signals G1 to G6 are not overlapped with one another in FIG. 9, the present inventive concept is not limited thereto. Alternatively, the waveforms of the gate signals G1 to G6 may be overlapped with one another. For example, the waveforms of the gate signals G1 to G6 are overlapped with one another for precharge.

In addition, although FIG. 9 shows that the falling edge of the gate signals (31 to G5 correspond to the rising edge of the next gate signals G2 to G6 in FIG. 9, the present inventive concept is not limited thereto.

At the beginning of the blank period, a blank start signal VSTR is applied. When the blank start signal VSTR is applied to the gate driver, the first to sixth gate signals G1 to G6 are simultaneously turned on.

Although FIG. 9 shows that the first to sixth gate signals G1 to G6 have a rising edge corresponding to a rising edge of the blank vertical start signal VSTR in FIG. 9, the present inventive concept is not limited thereto. Alternatively, the first to sixth gate signals G1 to G6 may have a rising edge corresponding to a falling edge of the blank vertical start signal VSTR.

During the active period, the data driver 240 outputs target data voltages corresponding to target grayscale values to the data lines DL. The target grayscale values correspond to respective pixels of the display panel 100. Thus, the number of the target grayscale values may correspond to the number of the pixels during the frame.

During the blank period, the data driver 240 outputs a compensating data voltage corresponding to the compensating grayscale value. During the blank period, all of the gate lines are simultaneously turned on so that the compensating grayscale value may correspond to all of the pixels of the display panel 100. Thus, the number of the compensating grayscale value may be one in the frame. According to an embodiment, of the inventive concept the compensating grayscale value may be set for each data line during the frame. Thus, the number of the compensating value may correspond to the number of the data lines in the frame.

For example, according to an embodiment of the inventive concept, the compensating grayscale value may be less than a medium grayscale value (a medium grayscale value being the average of a maximum grayscale value and zero gray). As explained with reference to FIGS. 4A to 7B, when the target grayscale value changes from a high luminance to a low luminance, the falling timing (fall time) of the data voltage may be so slow in falling to a logic low that the display panel 100 may display an undesirable color because there is an unintended display by a pixel that ideally should be off. Thus, during the blank period, the compensating grayscale value having the low luminance (e.g. at least lower than a medium level) may be applied to the display panel 100.

The data line DL may be floated by the data driver 240 when the target grayscale value is equal to the compensating grayscale value during the active period. When the data line DL is floated, the target grayscale value may not be applied to the pixel in the active period. However, the compensating grayscale value, which in this case is substantially equal to the target grayscale value, is applied to the pixel during the blank period. Thus, the pixel may display the desired luminance because of the compensating grayscale value impacts the undesired pixel voltage from causing an undesired display, typically in the form of an unwanted/mixed color.

The data driver 240 outputs the target data voltage corresponding to the target grayscale value to the data line DL when the target grayscale value is not equal to the compensating grayscale value in the active period.

In FIG. 10A, the display panel 100 may represent, for example, a red image. In FIG. 10A, green target grayscale values and blue target grayscale values may be respectively zero.

In a first horizontal period when the first gate signal G1 is activated, the data voltage DV may rise to display the red grayscale value. In a second horizontal period when the second gate signal G2 is activated, the target grayscale value and the compensating grayscale value are respectively zero, so that the data line DL is floated. When the data line DL is floated, the data voltage DV may not have fallen to a logic low level, but the data voltage may be steadily discharged. Floating the data line DL is called to high impedance (Hi-Z) output of the data driver 240. In a third horizontal period when the third gate signal G3 is activated, the target grayscale value and the compensating grayscale value are respectively zero, so that the data line DL is maintained in a floating state (being floated). In a fourth horizontal period when the fourth gate signal G4 is activated, the data voltage DV may no longer be in a floating state and may have risen again to display the red grayscale value.

In FIG. 10B, the display panel 100 may represent the red image. In FIG. 10B, green target grayscale values and blue target grayscale values may be respectively zero.

In a first horizontal period when the first gate signal G1 is activated, the data voltage DV may have risen to display the red grayscale value. In a second horizontal period when the second gate signal G2 is activated, the target grayscale value and the compensating grayscale value are respectively zero, so that the data line DL is floated. When the data line DL is floated, the data voltage DV may not be fallen to a low logic level but the data voltage may be steadily discharged. In a third horizontal period when the third gate signal G3 is activated, the target grayscale value and the compensating grayscale value are respectively zero, so that the data line DL is maintained being floated. In a fourth horizontal period when the fourth gate signal G4 is activated, the data voltage DV may rise again to display the red grayscale value.

However, in FIG. 10B, in a boundary of the third horizontal period and the fourth horizontal period, the data voltage applied to the data line DL is pulled down by the zero grayscale of the blue pixel and rises by the red grayscale value.

The data voltage DV may have the waveform of FIG. 10A or the waveform of FIG. 10B according to a delicate difference of the timing when the floated data line DL is connected again to the data driver 240 and the pixels in a boundary of the third horizontal period and the fourth horizontal period.

Figure 11:
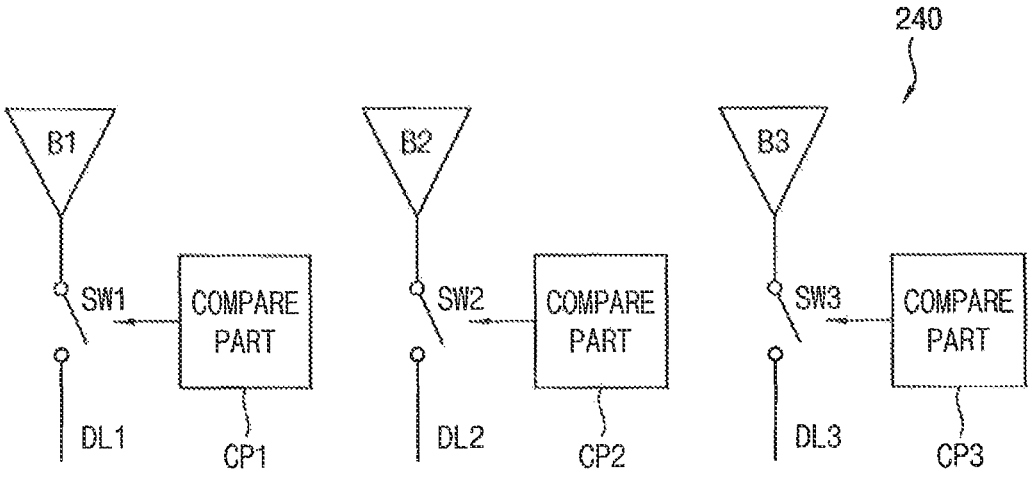
FIG. 11 is a circuit diagram illustrating a data driver of FIG. 1.

FIG. 11 is a circuit diagram illustrating the data driver 240 of FIG. 1.

Referring to FIGS. 1 and 11, the data driver 240 may include one or more buffers B1, B2 and B3 respectively outputting the target data voltage to a corresponding data lines DL1, DL2 and DL3. At least one comparator CP1, CP2 and CP3 determines whether the target grayscale value is equal to the compensating grayscale value and a data switch blocking connection between the buffers B1, B2 and B3 and the data lines DL1, DL2 and DL3 when the target grayscale value is equal to the compensating grayscale value.

One or more data switches SW1, SW2 and SW3 may block the respective connections between the buffers B1, B2 and B3 and the data lines DL1, DL2 and DL3 only during the active period.

When the data switches SW1, SW2 and SW3 respectively blocks the connection between the buffers B1, B2 and B3 and the respective data lines DL1, DL2 and DL3, the data line DL1, DL2 and DL3 is floated. When the data switch SW1, SW2 and SW3 respectively blocks the connection between the buffers B1, B2 and B3 and the respective data lines DL1, DL2 and DL3, it is referred to the data driver 240 outputs the high impedance (Hi-Z) output.

Figure 12A:
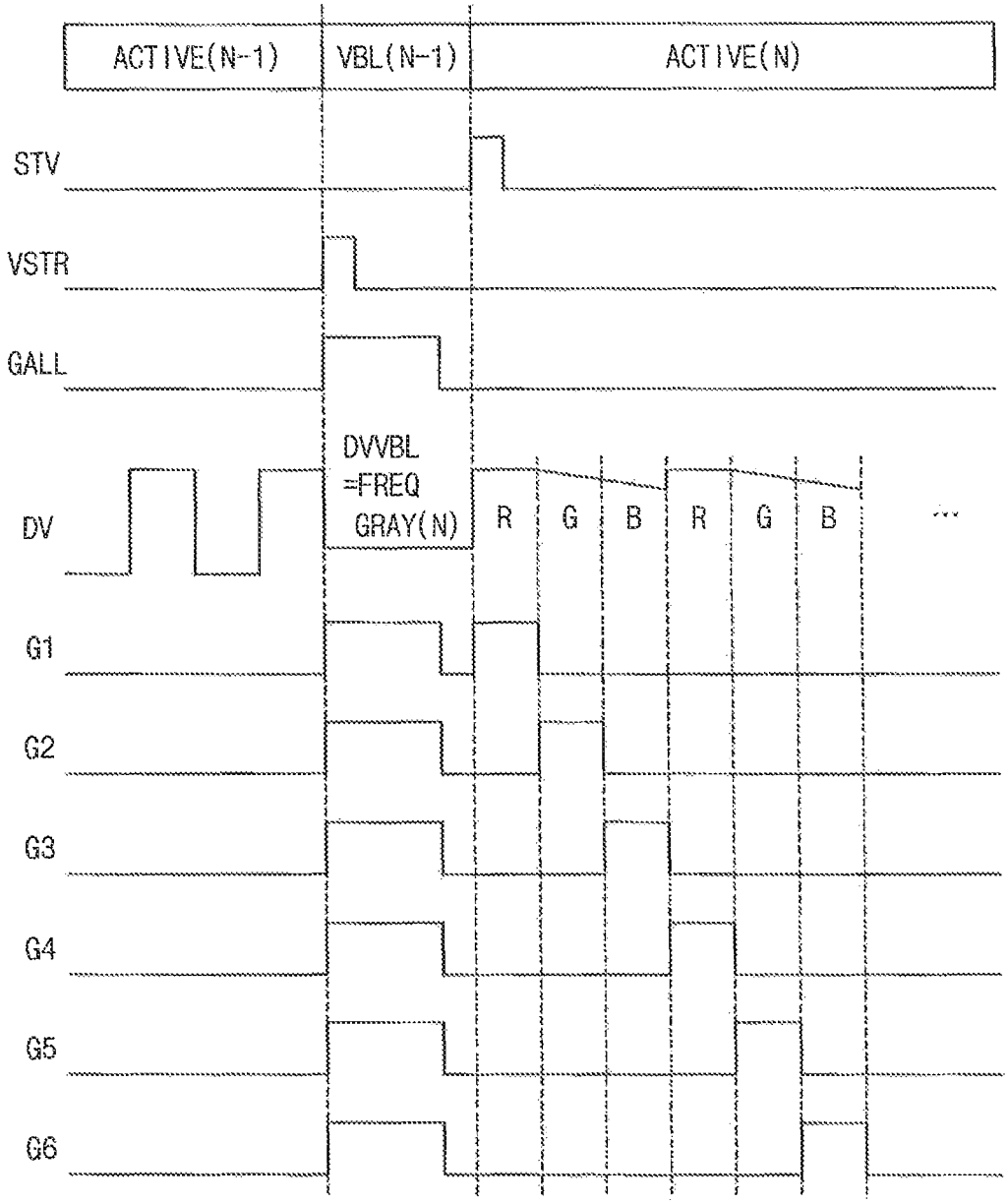
FIG. 12A is a waveform diagram illustrating signals representing the method of driving the display panel of FIG. 2 when the display panel of FIG. 2 represents a red image and a compensating grayscale value is the most frequent grayscale value.
Figure 12B:
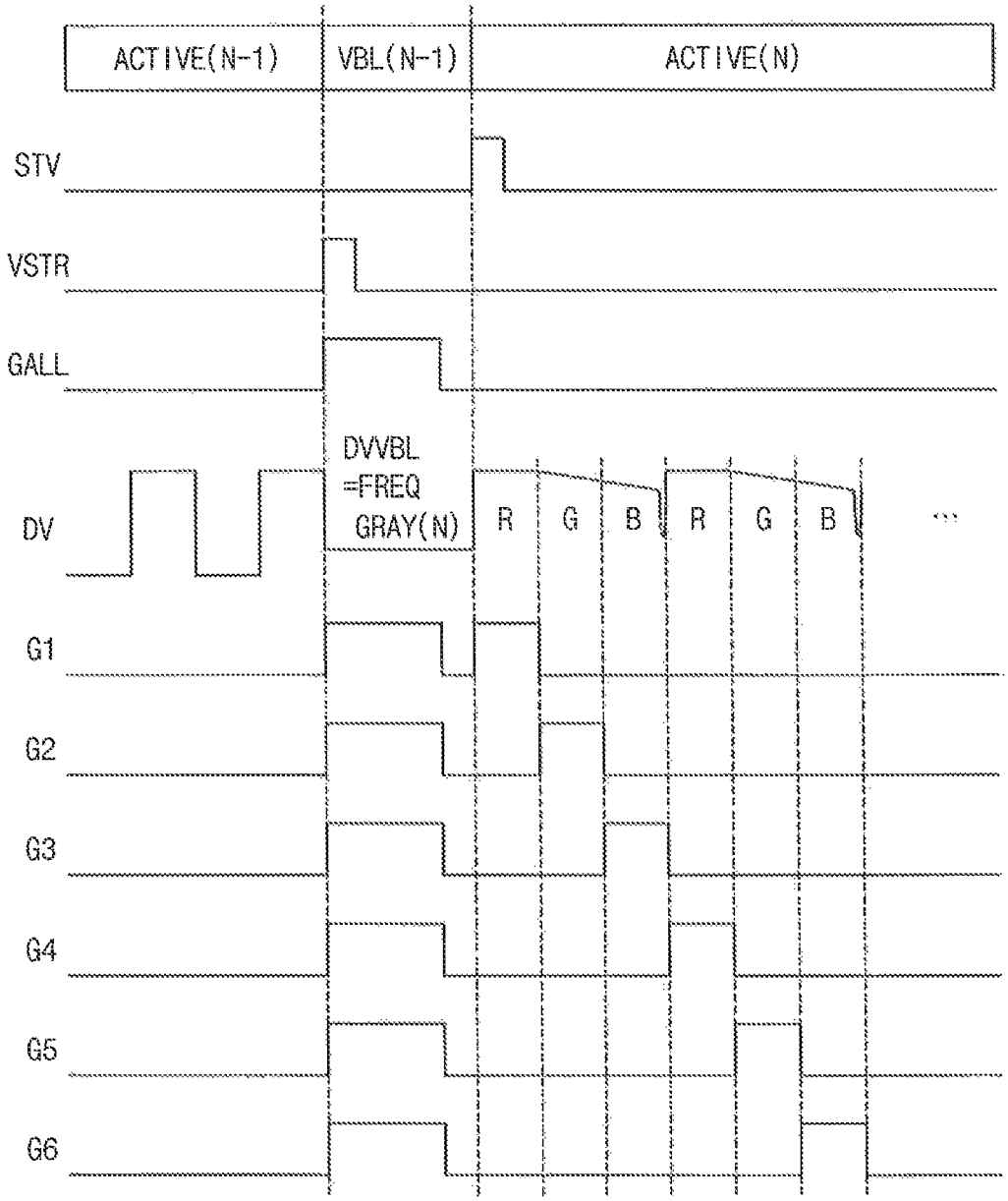
FIG. 12B is a waveform diagram illustrating signals representing the method of driving the display panel of FIG. 2 when the display panel of FIG. 2 represents a red image and the compensating grayscale value is the most frequent grayscale value.

FIG. 12A is a waveform diagram illustrating signals representing the method of driving the display panel 100 of FIG. 2 when the display panel 100 of FIG. 2 represents a red image and a compensating grayscale value is the most frequent grayscale value. FIG. 12B is a waveform diagram illustrating signals representing the method of driving the display panel 100 of FIG. 2 when the display panel 100 of FIG. 2 represents a red image and the compensating grayscale value is the most frequent grayscale value.

Referring to FIGS. 1 to 12B, during the blank period, the data driver 240 outputs a compensating data voltage corresponding to the compensating grayscale value. During the blank period, all of the gate lines are simultaneously turned on (e.g. substantially simultaneously) so that the compensating grayscale value may correspond to all of the pixels of the display panel 100. Thus, the number of the compensating grayscale value may be one in the frame. According to an embodiment, the compensating grayscale value may be set for each individual data line during the frame. Thus, the number of the compensating value may correspond to the number of the data lines activated in the frame.

For example, the compensating grayscale value may be the most frequent grayscale value FREQ GRAY(N) among all of the target grayscale values corresponding to all of the target data voltages applied to all of the data lines in the active period.

For example, the compensating grayscale value of the blank period VBL(N−1) may be the most frequent grayscale value FREQ GRAY(N) among all of the target grayscale values corresponding to all of the target data voltages applied to all of the data lines in the active period ACTIVE (N) right after the blank period VBL(N−1).

The most frequent grayscale value FREQ GRAY(N) may be determined by the timing controller 220. The timing controller 220 may use a memory and/or a memory configured as a counter to determine the most frequent grayscale value FREQ GRAY(N). The memory may be, for example, a frame memory.

The data line DL may be floated by the data driver 240 when the target grayscale value is equal to the compensating grayscale value in the active period. When the data line DL is floated, the target grayscale value may not be applied to the pixel in the active period, but the compensating grayscale value, which is equal to the target grayscale value, is applied to the pixel during the blank period. Thus, the pixel may display the desired luminance.

The data driver 240 outputs the target data voltage corresponding to the target grayscale value to the data line DL when the target grayscale value is not equal to the compensating grayscale value during the active period.

In FIG. 12A, the display panel 100 may represent the red maximum grayscale value. In FIG. 12A, the target grayscale values in second and third horizontal period may be equal to the compensating grayscale value.

In a first horizontal period when the first gate signal G1 is activated, the data voltage DV may rise to display the red grayscale value. In a second horizontal period when the second gate signal G2 is activated, the target grayscale value and the compensating grayscale value are equal to each other, so that the data line DL is floated. When the data line DL is floated, the data voltage DV may not fall to a low logic level, but the data voltage may be steadily discharged. In a third horizontal period when the third gate signal G3 is activated, the target grayscale value and the compensating grayscale value are equal to each other, so that the data line DL is maintained in a floated state. In a fourth horizontal period when the fourth gate signal G4 is activated, the data voltage DV may rise again to display the red grayscale value.

In FIG. 12B, the display panel 100 may represent the red maximum grayscale value. In FIG. 12B, the target grayscale values in second and third horizontal period may be equal to the compensating grayscale value.

In a first horizontal period when the first gate signal G1 is activated, the data voltage DV may rise to display the red grayscale value. In a second horizontal period when the second gate signal G2 is activated, the target grayscale value and the compensating grayscale value are equal to each other, so that the data line DL is floated. When the data line DL is floated, the data voltage DV may not be fallen but the data voltage may be steadily discharged. In a third horizontal period, when the third gate signal G3 is activated, the target grayscale value and the compensating grayscale value are equal to each other, so that the data line DL is maintained as being floated. In a fourth horizontal period when the fourth gate signal G4 is activated, the data voltage DV may rise again to display the red grayscale value.

However, in FIG. 12B, in a boundary of the third horizontal period and the fourth horizontal period, the data voltage applied to the data line DL is pulled down by the most frequent grayscale value of the blue pixel and is then rises by the red grayscale value.

The data voltage DV may have the waveform of FIG. 12A or the waveform of FIG. 12B according to a delicate difference of the timing when the floated data line DL is connected again to the data driver 240 and the pixels in a boundary of the third horizontal period and the fourth horizontal period. As shown in the case of the waveform of FIG. 12B, the signal G3 starts pulling down the data voltage DV.

During the blank period, the compensating gate signal may be selectively outputted to the display panel 100 and the compensating grayscale value may be selectively applied to the pixels of the display panel 100. For example, during the blank period, the compensating gate signal may be selectively outputted to the display panel 100 and the compensating grayscale value may be selectively applied to the pixels of the display panel 100 according to the input image data of the display panel 100.

For example, when the input image data of the display panel 100 is the single color image displaying only one of the first color, or one of the second color, or one of the third color in the active period as previously explained with reference to FIGS. 4A to 6B, or when the input image data of the display panel 100 is the mixed color image displaying only two of the first color, the second color and the third color in the active period (as previously explained with reference to FIGS. 7A and 7B), the compensating gate signal may be outputted to the display panel 100 and the compensating grayscale value may be applied to the pixels of the display panel 100 during the blank period.

In contrast, when the input image data of the display panel 100 is not the single color image or the mixed color image (comprised of, for example, two colors), the compensating gate signal may not be outputted to the display panel 100 during the blank period.

Figure 13A:
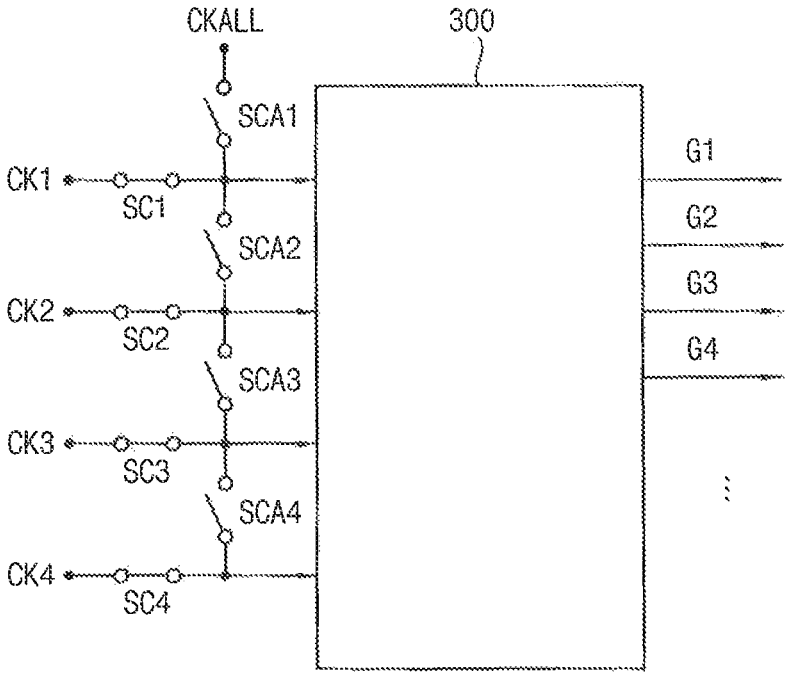
FIGS. 13A and 13B are circuit diagrams illustrating an operation of input and output components of a gate driver of FIG. 1.
Figure 13B:
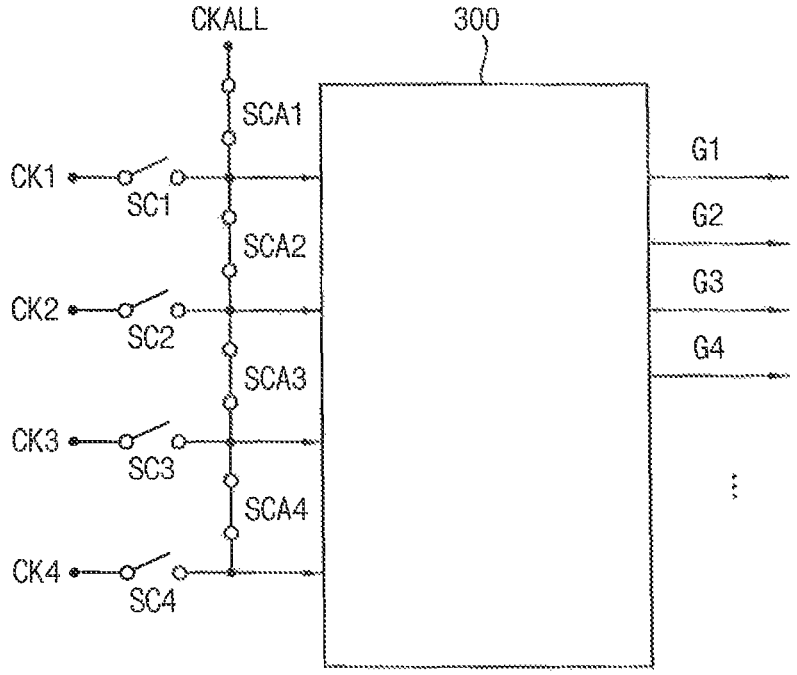

FIGS. 13A and 13B are circuit diagrams illustrating an operation of input and output parts of the gate driver 300 of FIG. 1.

Referring to FIGS. 1 to 13B, the gate driver 300 may generate the compensating gate signals and the scan gate signals based on a plurality of clock signals CK1 to CK4. An input part of the gate driver 300 may include a first group of clock switches SC1 to SC4 disposed on clock applying lines, which apply the clock signals CK1 to CK4 to the gate driver 300, and a second group of clock switches SCA1 to SCA4 connected between the clock applying lines. As shown in FIG. 13A, one (e.g. SCA1) of the second group of clock switches SCA1 to SCA4 may be connected between a node applying a clock global signal CKALL and a first clock applying line during the blank period. Alternatively, one (not shown in the figures) of the second group of clock switches may be connected between a node applying a clock global signal CKALL and a last clock applying line during the blank period.

During the blank period, all of the first group of the clock switches SC1 to SC4 are turned off and all of the second group of the clock switches SCA1 to SCA4 are turned on. FIG. 13B may represent the aforementioned operating condition. Thus, during the blank period, the clock global signal CKALL may be applied to the gate driver 300 instead of the plurality of the clock signals. The gate driver 300 may generate the compensating gate signal based on the clock global signal CKALL. For example, the gate driver 300 may generate a gate global signal (GALL in FIG. 9) based on the clock global signal CKALL and generates the gate signals (e.g. G1 to G6) having the same timing based on the gate global signal (GALL in FIG. 9).

During the active period, all of the first group of the clock switches SC1 to SC4 are turned on and all of the second group of the clock switches SCA1 to SCA4 are turned off. Thus, during the active period, the clock signals (e.g. CK1 to CK4) having different timings are respectively applied to the gate driver 300. The gate driver 300 may generate the scan gate signals based on the clock signals (e.g. CK1 to CK4). FIG. 13A may represent the operation as described during the active period.

Although four clock signals CK1 to CK4 are applied to the gate driver 300 in FIGS. 13A and 13B, the present inventive concept is not limited the number of the clock signals.

According to the present embodiment, the compensating grayscale value is applied to the data lines DL during the blank period, and the target grayscale value is not applied to the data line DL, but the data line DL may be floated when the compensating grayscale value is equal to the target grayscale value in the active period. Accordingly, the toggling of the data voltage applied to the data line DL may be reduced. Thus, the display defect which displays an undesirable color on the display panel 100 due to the delay of the falling timing of the data voltage DV may be reduced. Therefore, the display quality of the display panel 100 may be enhanced at least from the reduction in toggling of the data voltage applied to the data line DL.

Figure 14A:
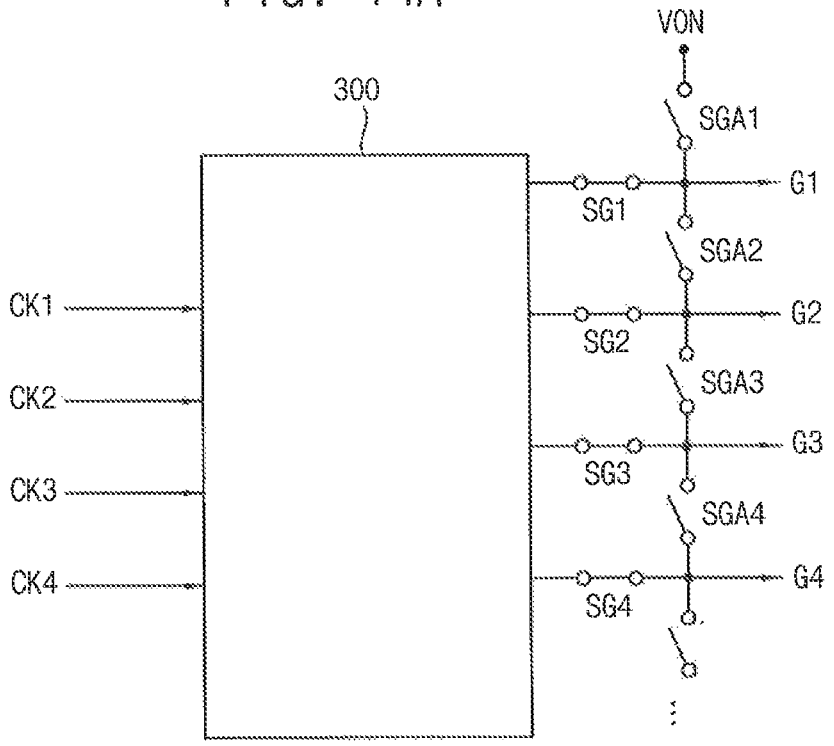
FIGS. 14A and 14B are circuit diagrams illustrating an operation of input and output components of a gate driver according to an embodiment of the present inventive concept.
Figure 14B:
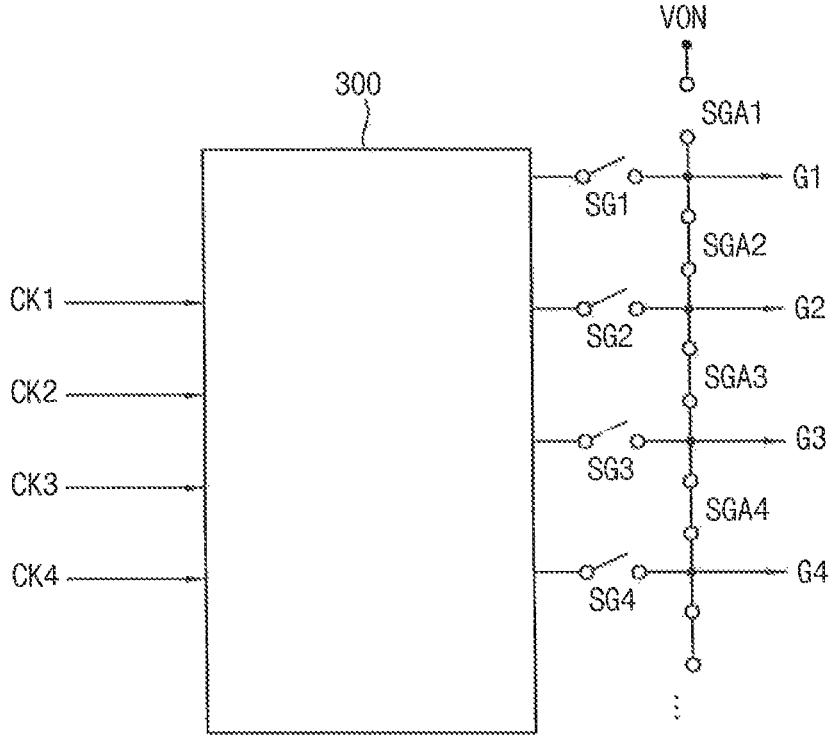

FIGS. 14A and 14B are circuit diagrams illustrating an operation of input and output parts of a gate driver 300 according to an embodiment of the present inventive concept.

The display apparatus and the method of driving the display panel according to the present embodiment is similar to the display apparatus and the method of driving the display panel of the previous embodiment explained referring to FIGS. 1 to 13B. However, at least one difference is with regard to the input part and the output part of the gate driver. Thus, the same reference numerals will be used to refer to the same or like parts as those described in the previous embodiment of FIGS. 1 to 13B and any repetitive explanation concerning the above elements will be omitted.

Referring to FIGS. 1 to 12B, 14A and 14B, the gate driver 300 may generate the compensating gate signals and the scan gate signals based on a plurality of clock signals CK1 to CK4 connected to the input part of the gate driver. An input part of the gate driver 300 may not include a first group of clock switches (SC1 to SC4 in FIGS. 13A and 13B) and a second group of clock switches (SCA1 to SCA4 in FIGS. 13A and 13B).

As shown in FIG. 14A, an output part of the gate driver 300 may include a first group of gate switches SG1 to SG4 disposed on the gate lines and a second group of gate switches SGA1 to SGA4 connected between the gate lines. One (e.g. SGA1) of the second group of gate switches SGA1 to SGA4 may be connected between a node applying a gate on voltage VON to generate the gate signal during the blank period and a first gate line. Alternatively, one (not shown in figures) of the second group of gate switches may be connected between a node applying the gate on voltage VON to generate the gate signal during the blank period and a last gate line.

During the blank period, all of the first group of the gate switches SG1 to SG4 are turned off and all of the second group of the gate switches SGA1 to SGA4 are turned on. Thus, during the blank period, the gate driver 300 may output the compensating gate signal to the gate lines of the display panel 100. FIG. 14B shows an operation as described during the blank period.

During the active period, all of the first group of the gate switches SG1 to SG4 are turned on and all of the second group of the gate switches SGA1 to SGA4 are turned off. Thus, during the active period, the gate driver 300 may output the scan gate signals having different timings to the gate lines of the display panel 100. FIG. 14A shows an operation as described during the active period.

According to the present embodiment, the compensating grayscale value is applied to the data lines DL during the blank period, and the target grayscale value is not applied to the data line DL but the data line DL may be floated when the compensating grayscale value is equal to the target grayscale value in the active period. Accordingly, the toggling of the data voltage applied to the data line DL may be reduced. Thus, the display defect which displays an undesirable color on the display panel 100 due to the delay of the falling timing of the data voltage DV may be reduced. Therefore, the display quality of the display panel 100 may be enhanced.

Figure 15:
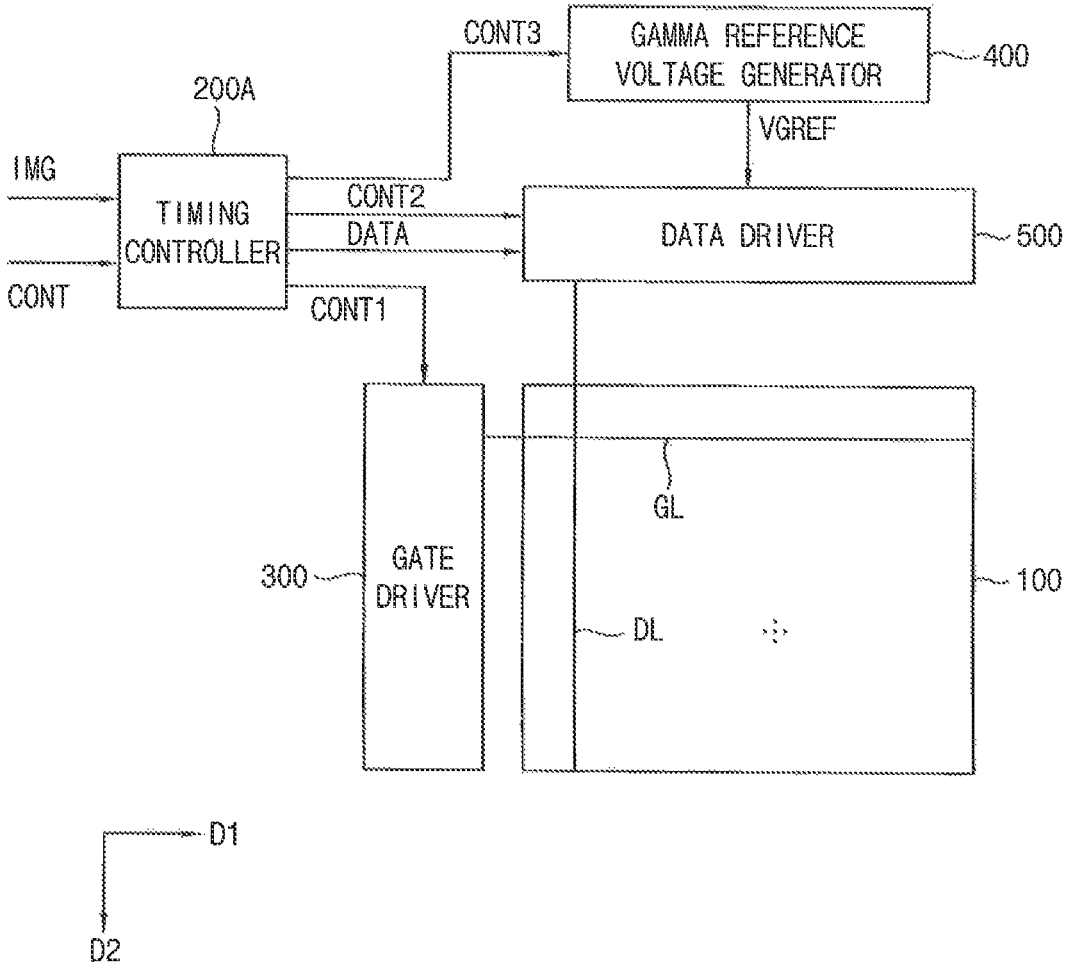
FIG. 15 is a block diagram illustrating a display apparatus according to an embodiment of the present inventive concept.

FIG. 15 is a block diagram illustrating a display apparatus according to an embodiment of the present inventive concept.

The display apparatus according to the present embodiment is substantially similar to the display apparatus of the previous embodiment explained with reference to FIGS. 1 to 13B except for the structure of the timing controller and the data driver. Thus, the same reference numerals will be used to refer to the same or like parts as those described in the previous embodiment of FIGS. 1 to 13B and any repetitive explanation concerning the above elements will be omitted.

Referring to FIGS. 2 to 15, the display apparatus includes a display panel 100 and a display panel driver. The display panel driver includes a timing controller 200A, a gate driver 300, a gamma reference voltage generator 400 and a data driver 500.

In the present embodiment, the timing controller 200A and the data driver 500 may be formed as different chips.

The display panel 100 displays an image in a unit of frame. The single frame includes an active period and a blank period.

During the active period, scan gate signals having different timings may be applied to the gate lines. For example, during the active period, the scan gate signals may be sequentially applied to the scan gate lines.

During the blank period, compensating gate signals having a same timing may be applied to the gate lines.

During the active period, the data driver 500 outputs target data voltages corresponding to target grayscale values to the data lines DL. The target grayscale values correspond to respective pixels of the display panel 100. Thus, the number of the target grayscale values may correspond to the number of the pixels during the frame.

During the blank period, the data driver 500 outputs a compensating data voltage corresponding to the compensating grayscale value. During the blank period, all of the gate lines are simultaneously turned on so that the compensating grayscale value may correspond to all of the pixels of the display panel 100. Thus, the number of the compensating grayscale value may be one in the frame. According to an embodiment, the compensating grayscale value may be set for each data line during the frame. Thus, the number of the compensating value may correspond to the number of the data lines in the frame.

According to the present embodiment, the compensating grayscale value is applied to the data lines DL during the blank period, and the target grayscale value is not applied to the data line DL, but the data line DL may be floated when the compensating grayscale value is equal to the target grayscale value in the active period. Accordingly, the toggling of the data voltage applied to the data line DL may be reduced. Thus, the display defect which displays an undesirable color on the display panel 100 due to the delay of the falling timing of the data voltage DV may be reduced. Therefore, the display quality of the display panel 100 may be enhanced.

Figure 16:
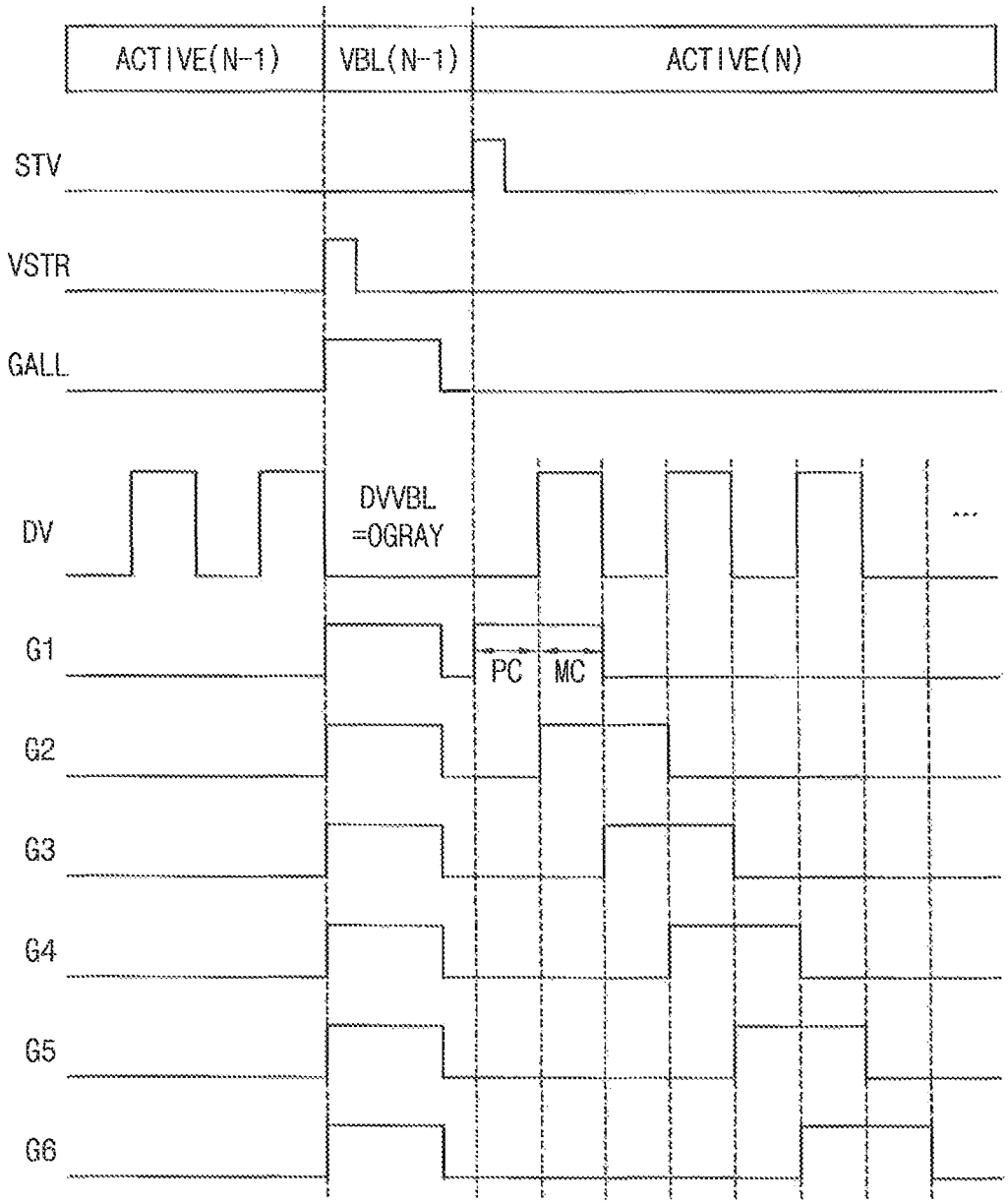
FIG. 16 is a waveform diagram illustrating signals representing a method of driving the display panel of FIG. 2 according to an embodiment of the present inventive concept.
Figure 17A:
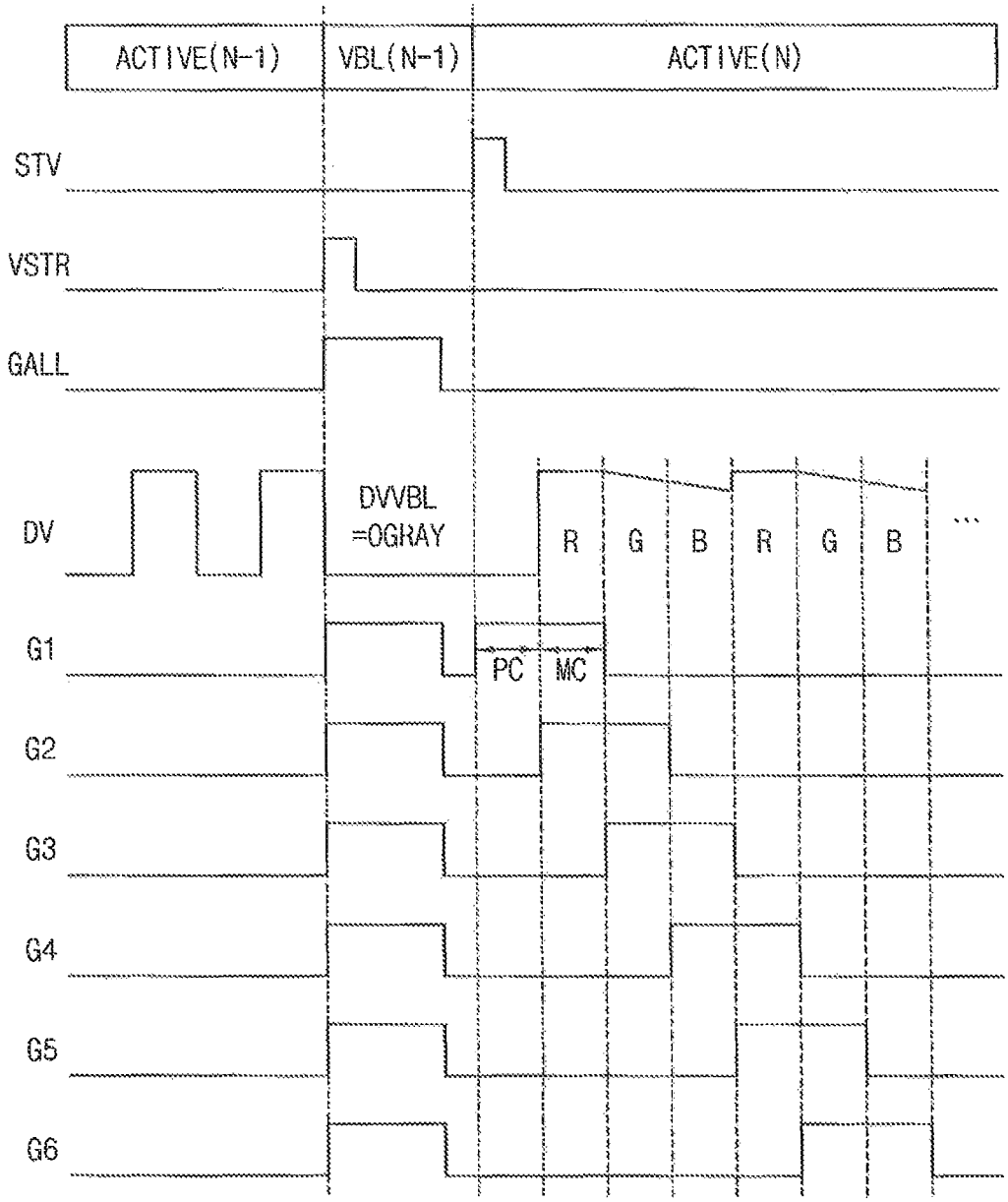
FIG. 17A is a waveform diagram illustrating signals representing the method of driving the display panel of FIG. 2 when the display panel of FIG. 2 represents the red image and a compensating grayscale value is zero gray.
Figure 17B:
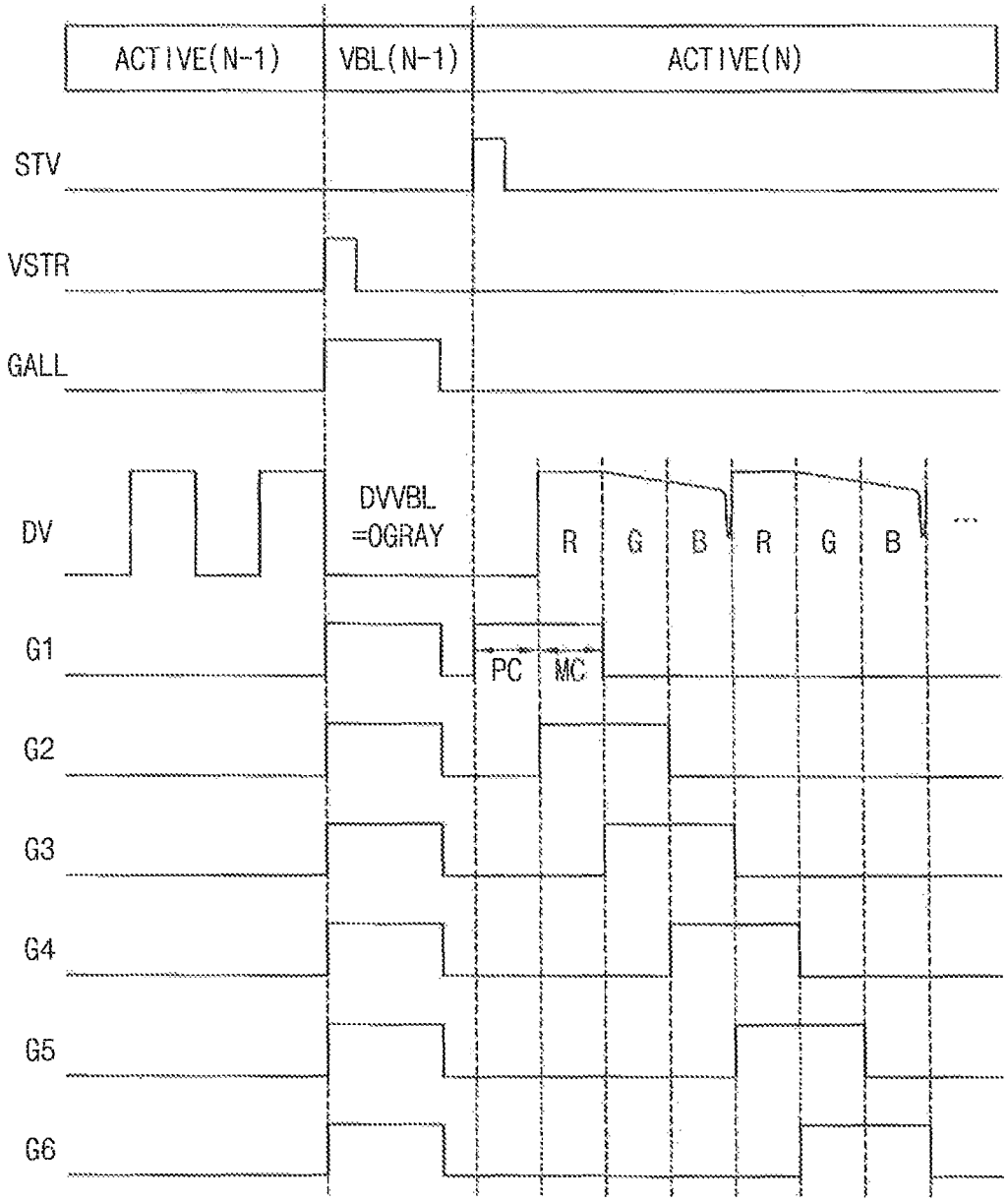
FIG. 17B is a waveform diagram illustrating signals representing the method of driving the display panel of FIG. 2 when the display panel of FIG. 2 represents the red image and the compensating grayscale value is zero gray.

FIG. 16 is a waveform diagram illustrating signals representing a method of driving the display panel of FIG. 2 according to an embodiment of the present inventive concept. FIG. 17A is a waveform diagram illustrating signals representing the method of driving the display panel of FIG. 2 when the display panel of FIG. 2 represents the red image and a compensating grayscale value is zero gray. FIG. 17B is a waveform diagram illustrating signals representing the method of driving the display panel of FIG. 2 when the display panel of FIG. 2 represents the red image and the compensating grayscale value is zero gray.

The display apparatus and the method of driving the display panel according to the present embodiment is substantially similar to the display apparatus and the method of driving the display panel of the previous embodiment explained with reference to FIGS. 1 to 13B except that the gate driver operates a precharge driving method. Thus, the same reference numerals will be used to refer to the same or like parts as those described in the previous embodiment of FIGS. 1 to 13B and any repetitive explanation concerning the above elements will be omitted.

Referring to FIGS. 1 to 3B, FIGS. 8 and 16 to 17B, the display apparatus includes a display panel 100 and a display panel driver. The display panel driver includes a timing controller 220, a gate driver 300, a gamma reference voltage generator 400 and a data driver 240.

The display panel 100 displays an image in a unit of frame. The single frame includes an active period and a blank period.

During the active period, scan gate signals having different timings may be applied to the gate lines. For example, during the active period, the scan gate signals may be sequentially applied to the scan gate lines.

In the present embodiment, the active period may include a precharge period PC and a main charge period MC to increase the charging rate of the data voltage of the pixel. The gate driver 300 may apply the scan gate signals during the precharge period PC and the main charge period MC.

During the blank period, compensating gate signals having the same timing may be applied to the gate lines.

In FIG. 16, a vertical start signal STV is applied at the beginning of the active period. When the vertical start signal STV is applied to the gate driver, the first to sixth gate signals G1 to G6 are sequentially turned on.

In addition, the waveforms of the gate signals G1 to G6 are overlapped with one another in FIG. 16. Although the precharge period PC corresponds to a single horizontal period and the main charge period MC corresponds to a single horizontal period in FIG. 16, the present inventive concept is not limited thereto. The precharge period PC may be longer than the main charge period MC. Alternatively, the precharge period PC may be shorter than the main charge period MC.

At the beginning of the blank period, a blank start signal VSTR is applied. When the blank start signal VSTR is applied to the gate driver, the first to sixth gate signals G1 to G6 are simultaneously turned on.

During the precharge period PC, the data driver 240 outputs precharge data voltages to the data lines DL. During the main charge period MC, the data driver 240 outputs target data voltages corresponding to the target data grayscales to the data lines DL. The target grayscale values correspond to respective pixels of the display panel 100. Thus, the number of the target grayscale values may correspond to the number of the pixels during the frame.

During the blank period, the data driver 240 outputs a compensating data voltage corresponding to the compensating grayscale value. During the blank period, all of the gate lines are simultaneously turned on so that the compensating grayscale value may correspond to all of the pixels of the display panel 100. Thus, the number of the compensating grayscale value may be one in the frame. According to an embodiment, the compensating grayscale value may be set for each data line during the frame. Thus, the number of the compensating value may correspond to the number of the data lines in the frame.

For example, the compensating grayscale value may have the grayscale value being less than a medium grayscale value which is the average of a maximum grayscale value and zero gray. As explained with reference to FIGS. 4A to 7B, when the target grayscale value changes from a high luminance to a low luminance, the fall time of the data voltage can be slow such that the display panel 100 may display an undesirable color because the data voltage did not reach a sufficiently low logic level (e.g., the fall time is long). Thus, according to the inventive concept, during the blank period, the compensating grayscale value having the low luminance may be applied to the display panel 100.

The data line DL may be floated by the data driver 240 when the target grayscale value is equal to the compensating grayscale value in the active period. When the data line DL is floated, the target grayscale value may not be applied to the pixel in the active period, but during the blank period the compensating grayscale value (which is equal to the target grayscale value) is applied to the pixel. Thus, the pixel may display the desired luminance, because in the aforementioned operation, the luminance displayed by the pixel is not affected by the slow fall time of the data voltage.

The data driver 240 outputs the target data voltage corresponding to the target grayscale value to the data line DL when the target grayscale value is not equal to the compensating grayscale value in the active period.

In FIG. 17A, the display panel 100 may represent the red image. In FIG. 17A, respective green target grayscale values and respective blue target grayscale values may be zero.

In a main charge period of the first gate signal G1, the data voltage DV may rise to display the red grayscale value. In a main charge period of the second gate signal G2, the target grayscale value and the compensating grayscale value are respectively zero, so that the data line DL is floated. When the data line DL is floated, the data voltage DV may not have fallen, or sufficiently fallen to a low logic level, but the data voltage may be steadily discharged. Floating the data line DL is called to high impedance (Hi-Z) output of the data driver 240. In a main charge period of the third gate signal G3, the target grayscale value and the compensating grayscale value are respectively zero, so that the data line DL is maintained in a floated state. In a main charge period of the fourth gate signal G4, the data voltage DV may rise again to display the red grayscale value.

In FIG. 17B, the display panel 100 may represent the red image. In FIG. 17B, green target grayscale values and blue target grayscale values may be respectively zero.

In the main charge period of the first gate signal G1, the data voltage DV may rise to display the red grayscale value. In the main charge period of the second gate signal G2, the target grayscale value and the compensating grayscale value are respectively zero, so that the data line DL is floated. When the data line DL is floated, the data voltage DV may not be fallen but the data voltage may be steadily discharged. In the main charge period of the third gate signal G3, the target grayscale value and the compensating grayscale value are respectively zero, so that the data line DL is maintained being floated. In the main charge period of the fourth gate signal G4, the data voltage DV may rise again to display the red grayscale value.

However, in FIG. 17B, in a boundary area between the third horizontal period and the fourth horizontal period, the data voltage applied to the data line DL is pulled down by the zero grayscale of the blue pixel and then rises by the red grayscale value. Thus the data voltage DV as shown in FIG. 17B shows a quick dip downward from the zero grayscale of the blue pixel, followed by a rise due to the red grayscale value.

The data voltage DV may have the waveform of FIG. 17A, or the waveform of FIG. 17B, according to a difference of the timing when the floated data line DL is again connected to the data driver 240 and the pixels in a boundary of the third horizontal period and the fourth horizontal period. The difference is timing is a small difference.

Although the compensating grayscale value is zero gray in FIGS. 17A and 17B, the compensating grayscale value may be the most frequent grayscale value FREQ GRAY(N) from among all of the target grayscale values corresponding to all of the target data voltages applied to all of the data lines in the active period.

According to the present embodiment, the compensating grayscale value is applied to the data lines DL during the blank period, and the target grayscale value is not applied to the data line DL but the data line DL may be floated when the compensating grayscale value is equal to the target grayscale value in the active period. Accordingly, the toggling of the data voltage applied to the data line DL may be reduced. Thus, the display defect which displays an undesirable color on the display panel 100 due to the delay of the falling timing of the data voltage DV may be reduced. Therefore, the display quality of the display panel 100 may be enhanced.

According to the present inventive concept as explained above, the compensating grayscale value is applied to the data lines during the blank period so that the display quality of the display panel may be enhanced.

The foregoing is illustrative of the present inventive concept and is not to be construed as limiting thereof. Although some embodiments of the present inventive concept have been described herein, those skilled in the art will readily appreciate that many modifications are possible in the embodiments without materially departing from the novel teachings and advantages of the present inventive concept. Accordingly, all such modifications are within the scope of the present inventive concept as defined in the claims. In the claims, the use of any means-plus-function clauses cover the structures described herein as performing the recited function and not only structural equivalents but also equivalent structures. Therefore, it is to be understood that the foregoing is illustrative of the present inventive concept and is not to be construed as limited to the specific embodiments disclosed, and that modifications to the disclosed embodiments, as well as other embodiments, are intended to be included within the scope of the appended claims. The present inventive concept is defined by the following claims, with equivalents of the claims to be included therein.

What is claimed is:

1. A display apparatus comprising:

a display panel including a plurality of gate lines and a plurality of data lines, and configured to display an image based on input image data;

a first driver configured to output to the gate lines compensating gate signals having a same timing during a first period and to output scan gate signals having different timings to the gate lines during a second period; and a second driver configured to apply a respective compensating data voltage to the data lines corresponding to a compensating grayscale value during the first period, and to apply one or more target data voltages to the data lines corresponding to one or more target data grayscale values during the second period, wherein the target data grayscale values correspond to one or more pixels of the display panel.

2. The display apparatus of claim 1, wherein the first period comprises a blank period and the second period comprises an active period, wherein the different timings of the outputted scan gate signals in the active period are sequential, and wherein the same timing of the outputted compensating gate signals are simultaneous.

3. The display apparatus of claim 2, wherein the second driver includes a timing controller, and the active period includes a precharge period and a main charge period, and wherein the first driver applies the scan gate signals during the precharge period and the main charge period, and wherein the second driver is configured to output precharge data voltages to the data lines during the precharge period and output the target data voltages corresponding to the target data grayscale values to the data lines during the main charge period.

4. The display apparatus of claim 1, wherein the data line is floated by the second driver when the target data grayscale value is equal to the compensating grayscale value during the second period.

5. The display apparatus of claim 4, wherein the second driver comprises:

a buffer configured to output the target data voltage to the data line;

a comparator configured to determine whether the target data grayscale value is equal to the compensating grayscale value; and a data switch configured to block connection between the buffer and the data line when the target data grayscale value is equal to the compensating grayscale value.

6. The display apparatus of claim 1, wherein the compensating grayscale value is zero gray.

7. The display apparatus of claim 1, wherein the compensating grayscale value is less than a medium grayscale value being an average of a maximum grayscale value and zero gray.

8. The display apparatus of claim 1, wherein the compensating grayscale value is a most frequent grayscale value from among all of the target data grayscale values corresponding to all of the target data voltages applied to all of the data lines in the second period.

9. The display apparatus of claim 1, wherein the display panel includes pixels disposed in a plurality of pixel rows, and the pixels disposed in a pixel row represent the same color.

10. The display apparatus of claim 9, wherein pixels disposed in a first pixel row from among the plurality of pixel rows are connected to a first gate line, and the pixels disposed in the first pixel row represent a first color, pixels disposed in a second pixel row from among the plurality of pixel rows are connected to a second gate line, the pixels disposed in the second pixel row represent a second color, pixels disposed in a third pixel row from among the plurality of pixel rows are connected to a third gate line, the pixels disposed in the third pixel row represent a third color, pixels disposed in a fourth pixel row from among the plurality of pixel rows are connected to a fourth gate line, the pixels disposed in the fourth pixel row represent the first color, pixels disposed in a fifth pixel row from among the plurality of pixel rows are connected to a fifth gate line, the pixels disposed in the fifth pixel row represent the second color, and pixels disposed in a sixth pixel row from among the plurality of pixel rows arc connected to a sixth gate line, the pixels disposed in the sixth pixel row represent the third color.

11. The display apparatus of claim 1, wherein when the input image data is a single color image displaying only one of a first color, a second color and a third color in the second period or when the input image data is a mixed color image displaying only two of the first color, the second color and the third color in the second period, the first driver outputs compensating gate signals having the same driving timing in the first period, and when the input image data is not one of the single color image and the mixed color image, the first driver does not output compensating gate signals in the first period.

12. The display apparatus of claim 1, wherein the first driver is configured to generate compensating gate signals and the scan gate signals based on a plurality of clock signals, and an input part of the first driver comprises:

a first group of clock switches disposed on clock applying lines to apply the clock signals to the first driver; and a second group of clock switches connected between adjacent clock applying lines.

13. The display apparatus of claim 12, wherein during the first period, all of the first group of the clock switches are turned off and all of the second group of the clock switches are turned on, and during the second period, all of the first group of the clock switches are turned on and all of the second group of the clock switches are turned off.

14. The display apparatus of claim 1, wherein an output part of the first driver comprises:

a first group of gate switches disposed on the gate lines; and a second group of gate switches connected between adjacent gate lines.

15. The display apparatus of claim 14, wherein during the first period, all of the first group of the gate switches are turned off and all of the second group of the gate switches are turned on, and during the second period, all of the first group of the gate switches are turned on and all of the second group of the gate switches are turned off.

16. The display apparatus of claim 1, wherein the second period includes a precharge period and a main charge period, the first driver is configured to output the scan gate signals to the gate lines during the precharge period and the main charge period, and the second driver is configured to apply a precharge data voltage to the data lines during the precharge period and the target data voltage to the data Hues during the main charge period.

17. A method of driving a display panel, the method comprising:

outputting compensating gate signals having a same timing to a plurality of gate lines during a first period;

applying a compensating data voltage corresponding to a compensating grayscale value to a plurality of data lines during the first period;

outputting scan gate signals having different timings to the gate lines during a second period; and applying a target data voltage corresponding to a target data grayscale value to the data lines during the second period.

18. The method of claim 17, wherein the first period comprises a blank period and the second period comprises an active period, wherein the outputting of compensating gate signals arc sequential, and wherein the outputting of the scan gate signals during the blank period are simultaneous.

19. The method of claim 17, wherein the data line is floated when the target data grayscale value is equal to the compensating grayscale value during the second period.

20. The method of claim 17, wherein when an input image data is a single color image displaying only one of a first color, a second color and a third color in the second period, or when the input image data is a mixed color image displaying only two of the first color, the second color and the third color in the second period, outputting compensating gate signals having the same driving timing to the gate lines during the first period, and when the input image data is not one of the single color image and the mixed color image, compensating gate signals are not outputted to the gate lines during the first period.

21. The method of claim 17, wherein the outputting compensating gate signals and the scan gate signals includes generating compensating gate signals and the scan gate signals based on a plurality of clock signals by a first driver, and an input part of the first driver includes a first group of clock switches disposed on clock applying lines to apply the clock signals to the first driver; and a second group of clock switches connected between adjacent clock applying lines.

22. The method of claim 21, wherein during the first period, turning off all of the first group of the clock switches and turning on all of the second group of the clock switches, and during the second period, turning on all of the first group of the clock switches and turning off all of the second group of the clock switches.

23. The method of claim 17, wherein the compensating gate signals and the scan gate signals are generated based on a plurality of clock signals by a first driver, and an output part of the first driver includes:

a first group of gate switches disposed on the gate lines; and a second group of gate switches connected between adjacent gate lines, and during the first period, turning off all of the first group of the gate switches and turning on all of the second group of the gate switches, and during the second period, turning on all of the first group of the gate switches and turning off all of the second group of the gate switches.

* * * * *